US006992551B2

(12) United States Patent
Shimizu et al.

(10) Patent No.: US 6,992,551 B2
(45) Date of Patent: Jan. 31, 2006

(54) SWITCH AND METHOD FOR MANUFACTURING THE SAME

(75) Inventors: Norisato Shimizu, Kanagawa (JP); Yoshito Nakanishi, Tokyo (JP); Kunihiko Nakamura, Kanagawa (JP); Yasuyuki Naito, Tokyo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 269 days.

(21) Appl. No.: 10/628,549

(22) Filed: Jul. 28, 2003

(65) Prior Publication Data

US 2004/0069608 A1 Apr. 15, 2004

(30) Foreign Application Priority Data

Jul. 30, 2002 (JP) ..... 2002-221009
Jan. 30, 2003 (JP) ..... 2003-021852
Jul. 24, 2003 (JP) ..... 2003-279097

(51) Int. Cl.
*H01H 51/22* (2006.01)

(52) U.S. Cl. ..... 335/78; 200/181; 333/262; 359/291; 359/298

(58) Field of Classification Search ..... 29/622; 200/181; 257/415, 417; 333/262; 335/78–86; 310/36.9, 309, 328, 320, 366, 368, 312; 359/198, 359/214, 223, 224, 196, 290, 291, 298, 850
See application file for complete search history.

(56) References Cited

U.S. PATENT DOCUMENTS 6,133,807 A * 10/2000 Akiyama et al. ..... 333/262
6,291,922 B1 * 9/2001 Dhuler ..... 310/307
6,794,101 B2 * 9/2004 Liu et al. ..... 438/50
6,847,277 B2 * 1/2005 Hsu et al. ..... 335/78
6,850,133 B2 * 2/2005 Ma ..... 335/78
6,919,784 B2 * 7/2005 Feng et al. ..... 335/78
6,950,223 B2 * 9/2005 Huibers et al. ..... 359/291

OTHER PUBLICATIONS

S. Meninger et al. "Vibration-to-Electric Engery Conversion", Proceedings 1999 International Symposium on Low Power Electronics and Design, (ISLPED), Aug. 16-17, 1999, pp. 48-53.
M.A. Rosa et al. "Enhanced Electrostatic Force Generation Capability of Angled Comb Finger Design used in Electrostatic Comb-Drive Actuators", Electronics Letters, IEE Stevenage, GB, vol. 34, No. 18, Sep. 3, 1998, pp. 1787-1788.
E. Ollier et al. Integrated Electrostatic Micro-Switch for Optical Fibre Networks Driven by Low Voltage, Electronics Letters, IEE Stevenage, GB, vol. 32, No. 21, Oct. 10, 1996, pp. 2007-2009.

(Continued)

*Primary Examiner*—Michael A. Friedhofer
(74) *Attorney, Agent, or Firm*—RatnerPrestia

(57) ABSTRACT

Disclosed is a switch having a movable electrode to be separately driven downward and upward to secure signal transmission efficiency and insulation capability and operate for signal connection and disconnect at a high speed. The switch comprises a movable electrode, a fixed electrode positioned beneath the movable electrode, and a movable electrode driving fixed electrode positioned on both sides of the movable electrode with respect to a length wise direction thereof. Inside surfaces of the movable electrode, concave and convex parts are formed to arrange on both sides fixed electrodes having the corresponding concave and convex parts with a space.

23 Claims, 19 Drawing Sheets

OTHER PUBLICATIONS

European Search Report corresponding to application No. EP 03 01 6626 dated Oct. 20, 2003.

H.A.C. Tilmans et al., "Wafer-level packaged RF-MEMS switches fabricated in a CMOS fab" IEEE 2001 IEDM Tech. Digest 01 921-924 (41.4.1-41.4.4).

Dooyoung Hah et al., "A Low Voltage Actuated Microelectromechanical Switch for RF Application" JPN.J. Appl. Phys. vol. 40(2001) pp. 2721-2724.

Osamu Tuboi et al., "A Rotational Comb-Driven Micromirror with a Large Deflection Angle and Low Drive Voltage" IEEE 1002 MEMS Tech. Digest, pp. 532-535.

* cited by examiner

SWITCH AND METHOD FOR MANUFACTURING THE SAME

FIELD OF THE INVENTION

This invention relates to a switch improved in operation speed upon turning on/off and to a method for manufacturing such a switch.

BACKGROUND OF THE INVENTION

There is known a conventional signal switch as described in IEEE IEDM Tech. Digest 01, p921, 2001, for example. This is structured with a signal transmission line 2502 formed on a high-resistance silicon substrate 2501, a movable ground line 2503 arranged over the signal transmission line 2502 through a predetermined gap, and a ground line 2504, as shown in FIG. 1A. In this switch, a voltage is applied across a parallel plate capacitance comprising the movable ground line 2503 and signal transmission line 2502, whereby an electrostatic force is caused to put the movable ground line 2503 into contact with the signal transmission line 2502 through a high dielectric film 2505 as shown in FIG. 1B. By the contact, increased is the capacitance formed between the signal transmission line 2502 and movable ground line 2503, making it possible to transfer a signal having a frequency component dependent upon that capacitance.

By thus controlling the voltage between the movable ground line 2503 and the signal transmission line 2502, the signal transmission is connected and disconnected from the signal transmission line 2502 to the movable ground line 2503. Furthermore, with this scheme, a signal switch can be formed by the same process as an LSI fabrication process. By forming a signal switch at the same point as that of a circuit of transistors or the like, it is possible to form a switch advantageous in respect of frequency characteristic and size reduction.

As the means for improving the operation speed in both signal connection and disconnection, there is a proposal that a seesaw form is provided to drive the movable electrode in two directions, e.g. described in Jpn. J. Appl. Phys., Vol. 40, p2721, 2001. In IEEE MEMS 2002 Tech. Dig., p532,2002, there is also known a structure that a voltage is applied between a stationary comb electrode and a movable comb electrode, to rotate a reflection mirror.

The conventional switches require transmission efficiency in signal transmission, insulation capability upon disconnection and high-speed operation at signal connection and disconnection.

However, in the structure of FIG. 1, it is only the signal transmission line 2502 that acts to drive the movable ground line 2503. When the signal is switched from the transmission line 2502 to the ground line 2503, voltage is applied between the ground line 2503 and the transmission line 2502. However, in the case to disconnect a signal being conveyed to the ground line 2503, there is difficulty in increasing the switching speed, because the operation is carried out only by the spring returning force of a material structuring the ground line. In case the ground line 2503 uses a material having a high spring constant, it is possible to increase the switching speed in disconnecting the signal being conveyed to the ground line 2503. However, this involves problems, e.g. decreasing operation speed in switching from the transmission line 2502 to the ground line 2503, and requiring to increase the voltage to be applied to between the ground line 2503 and the transmission line 2502.

Meanwhile, in the process for fabricating the above structure, after forming the transmission line 2502, formed in a correct film thickness is a sacrificial layer that is formed by etching only a predetermined material without etching the transmission line 2502 and ground line 2503. Then, the ground line 2502 is formed. Thereafter, the sacrificial layer is removed between the transmission line 2502 and the ground line 2503, thereby accurately forming a predetermined gap. This is a general process in practice. According to this method, in case a three-layer structure is provided to further fix a movable contact line driving electrode on the ground line 2503, even when to disconnect the signal being conveyed to the ground line 2503, the ground line 2503 can be moved at a high speed.

However, such a three-layer structure requires to accurately form not only the below of the ground line 2503 but also a sacrificial layer above the ground line 2503, in the fabrication process. This makes the fabrication process complicated. Furthermore, in the case of the three-layer structure, a step is generated by comprising five layers, i.e. the transmission line 2502, sacrificial layer, ground line 2503, sacrificial layer and movable ground line driving electrode, in the fabrication process. It is practically impossible to carry out a process of forming a pattern or the like over such a high step.

Meanwhile, in the case of forming a switch by a beam structure as shown in FIG. 1B, stress is changed by a temperature change. This takes place where there is a difference in thermal expansion coefficient between the material structuring the beam and the material structuring a substrate. The beam stress change causes a change of beam spring constant, which in turn changes the switch response time and driving voltage. The beam, in the worst case, is known to be deformed 2 $\mu$m or greater by a temperature change. In order to achieve a high-speed response, the driving distance of the movable electrode must be set at a required minimum distance for obtaining a desired isolation. In this manner, the distance between the electrodes must be sufficiently long while taking into account the beam deformation amount by such a temperature change. This, however, further increases the response time.

On the other hand, in the case of a seesaw type, a capacitor capacitance is formed based on an overlap area of a signal electrode and a contact electrode. Because the magnitude of capacitance determines a transmission signal frequency and transmission efficiency, the size of the contact electrode is determined by a signal to be controlled in connection and disconnection. In order to obtain a connection/disconnection characteristic on a signal at a certain fixed frequency, it is impossible to reduce the size of the contact electrode. Furthermore, the entire mass of the movable electrode requires the part for forming a capacitor formed by a pull electrode and a push electrode, in addition to the contract electrode mass. As a result, there is needed to form an electrode at the part not directly involved in signal connection and disconnection, increasing the overall mass of the movable electrode. This is disadvantageous in connection and disconnection at a high speed.

In a driving scheme using a comb electrode, formation is comparatively easy for those for driving in an in-plane direction of a substrate. However, those for driving in a vertical direction to a substrate require to form a structure in a height direction, making the fabrication process complicated.

SUMMARY OF THE INVENTION

It is an object of the present invention to provide, in order to solve the problem, a switch having a movable electrode to be separately driven upwardly and downwardly thereby securing a signal transfer efficiency and insulation capability, and performing signal connection and disconnection at a high speed without the need for a structure height.

In order to solve the above object, a switch of the present invention comprises a movable electrode, a signal-transmitting fixed electrode positioned beneath the movable electrode, and a movable electrode driving fixed electrode positioned on both sides of the movable electrode with respect to lengthwise direction thereof. Convex and concave parts are formed in a side surface of the movable electrode. The movable electrode driving fixed electrode is formed with concave and convex parts corresponding to the convex and concave parts in the side surface of the movable electrode. The convex parts formed in the side surface of the movable electrode are arranged to be surrounded by the concave parts formed in the movable electrode driving fixed electrode, while the convex parts of the movable electrode driving fixed electrode are arranged to be surrounded by the concave parts in the side surface of the movable electrode. The downward driving of the movable electrode is made by an electrostatic force acted between the signal transmitting fixed electrode positioned beneath the movable electrode and the movable electrode, while the upward driving of the movable electrode is by an electrostatic force acted between the convex and concave parts of the movable electrode driving fixed electrode and the concave and convex parts formed in the side surface of the movable electrode. Accordingly, separation is possible between downward driving and upward driving, making it possible to reduce the structure height, secure signal transmission efficiency and insulation, and connect and disconnect a signal at a high speed.

Furthermore, the movable electrode, convex and concave parts in the side surface of the movable electrode, concave and convex parts of the movable electrode driving fixed electrode and a part of the movable electrode driving fixed electrode are formed on a resist sacrificial layer, the process for removing the sacrificial layer can be conducted by a dry process. This makes it possible to prevent an adsorption to an unintended region due to surface tension, i.e. so-called sticking, which is problematically encountered in a liquid process after removing the sacrificial layer.

DESCRIPTION OF THE EXEMPLARY EMBODIMENT

Exemplary embodiments of the present invention are demonstrated hereinafter with reference to the accompanying drawings.

1. First Exemplary Embodiment

Figure 2:
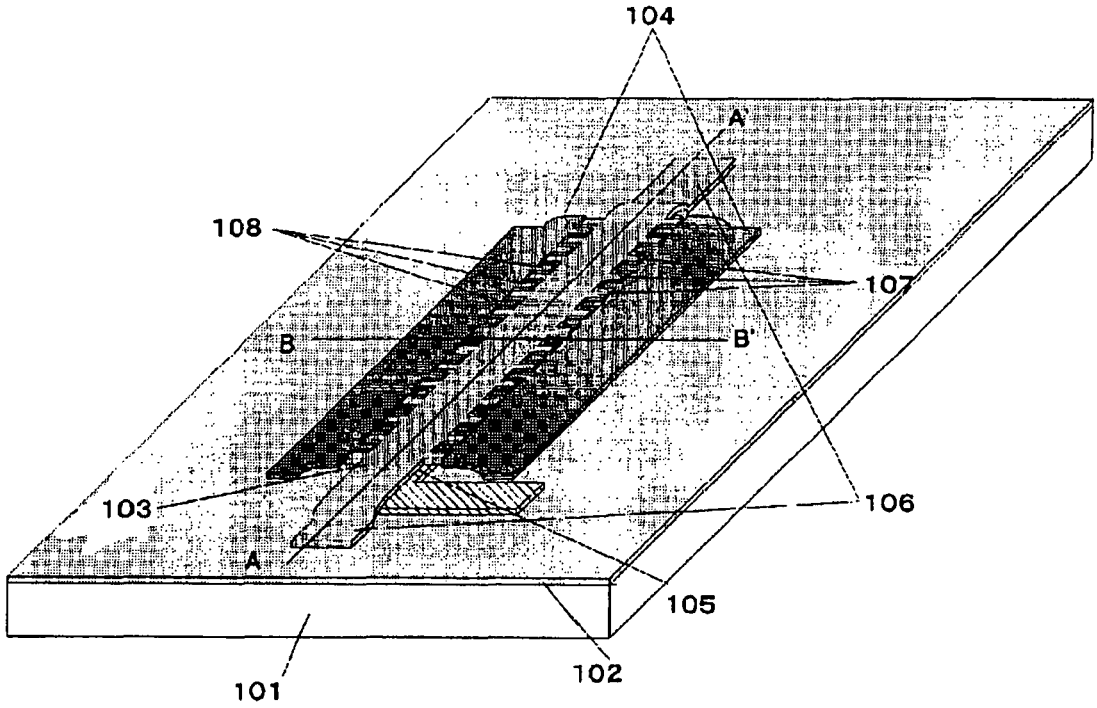
FIG. 2 is a perspective view of a switch in embodiment 1 of the present invention.

FIG. 2 is a perspective view of a switch in embodiment 1 of the present invention. This is structured by a movable electrode 103, a movable electrode driving fixed electrodes 104 and a signal transmitting fixed electrode 105, that are formed on a high resistive silicon substrate 101 through a silicon oxide film 102. The movable electrode 103 has a plurality of convex parts 107 in side surfaces thereof. In this embodiment 1, the convex parts 107 are assumed to be made all in the same form for convenience sake, and arranged at a periodic interval. Concave parts are formed between one convex part 107 and the adjacent convex part 107. The concave parts are also arranged at a periodic interval. The movable electrode driving fixed electrode 104 also has a plurality of convex parts 108 arranged, in its side surface, correspondingly to and surrounded by the concave parts of between the convex parts 107 on the side surface of the movable electrode. The concave parts 108 are similarly arranged at a periodic interval. The concave parts between the convex parts 108 are also arranged similarly at a periodic interval because they are formed between the adjacent concave parts 108.

The convex part 107 and the convex part 108 are in the same length of convex. The convex part 107 is surrounded by the concave parts of the movable electrode driving fixed electrode 106 with a predetermined gap having a shorter distance than a length of the convex part 107. Also, the convex part 108 is surrounded by the concave parts in the side surface of the movable electrode 103 with a predetermined gap having a shorter distance than a length of the convex part 108. Accordingly, arrangement is made in such a form that part of the convex part 107 lies in the concave of the movable electrode driving fixed electrode 104 while part of the convex part 108 lies in the concave of the movable electrode 103.

Figure 3:
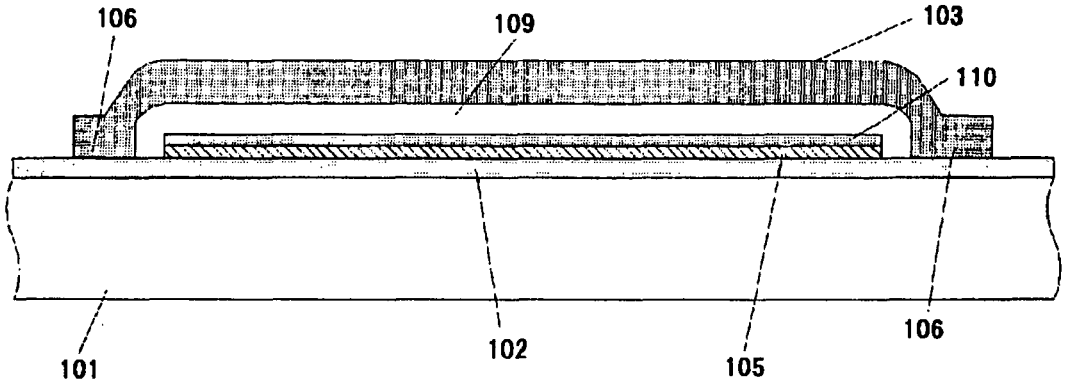
FIG. 3 is a sectional view along line A–A' in FIG. 2.

FIG. 3 is a sectional view along line A–A' in FIG. 2, showing a state that there is no connection between the signal transmitting fixed electrode 105 and the movable electrode 103. The signal transmitting fixed electrode 105 is arranged on a high-resistance silicon substrate 101 through a silicon oxide film 102. An electrode-to-electrode isolating silicon oxide film 110 is formed on the signal transmitting fixed electrode 105, on which a movable electrode 103 is further arranged through a capacitance reducing space 109. The movable electrode 103 has, at both ends thereof, movable electrode fixing regions 106 fixed on the substrate 101.

Figure 4:
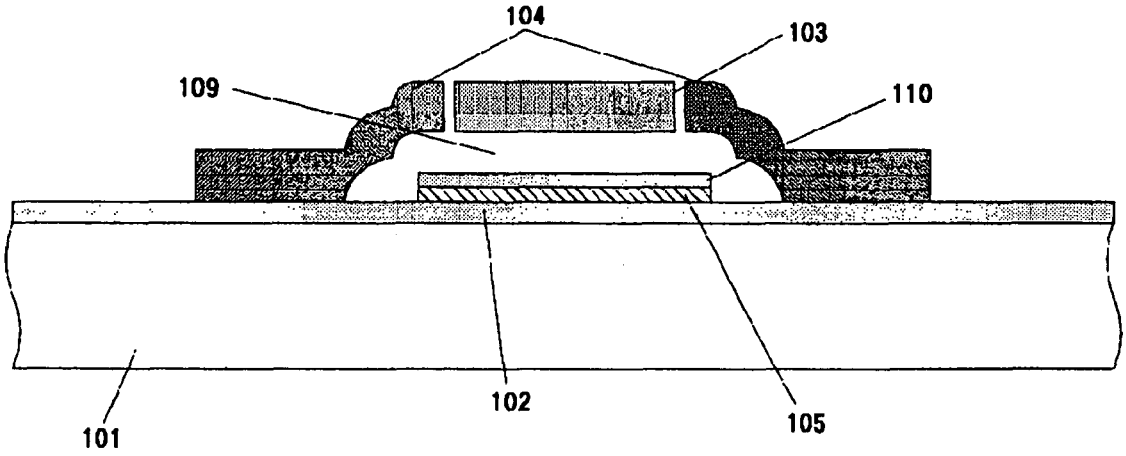
FIG. 4 is a sectional view along line B–B' in FIG. 2.

FIG. 4 is a sectional view along line B–B' in FIG. 2, showing a state that there is no connection between the signal transmitting fixed electrode 105 and the movable electrode 103. The movable electrode driving fixed electrode 104 and signal transmitting fixed electrode 105 are arranged on the high-resistance silicon substrate 301 through the silicon oxide film 102. The electrode-to-electrode isolating silicon oxide film 110 is formed on the signal transmitting fixed electrode 105, on which the movable electrode 103 is further arranged through the capacitance reducing space 109. This embodiment 1 is designed such that the convex part 108 of the movable electrode driving fixed electrode 104 and the movable electrode 103 positioned through the capacitance reducing space 309 have the same height with respect to a substrate surface.

Figure 5:
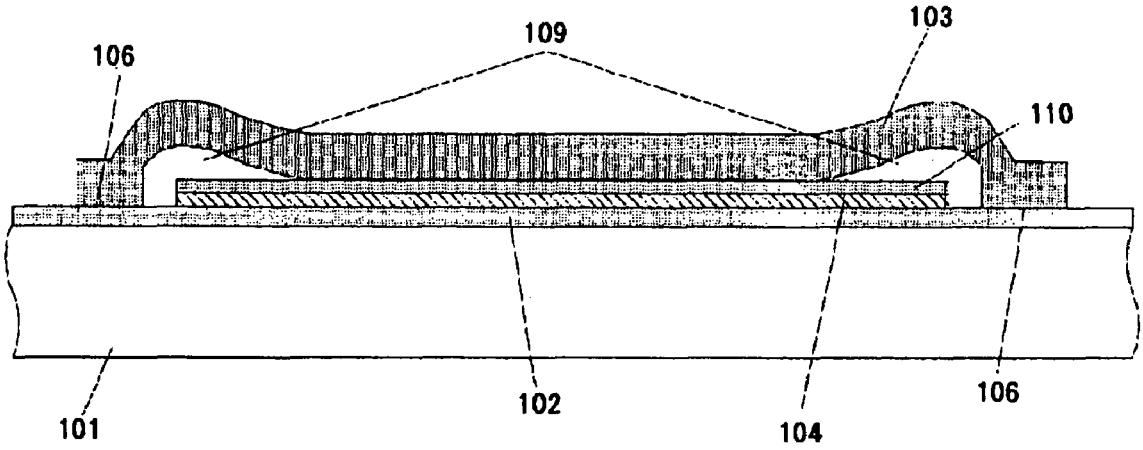
FIG. 5 is a sectional view showing a connection state of the switch in the section A–A' in FIG.2.

FIG. 5 is a sectional view along line A–A' in FIG. 2, showing a state that there is a connection between the signal transmitting fixed electrode 405 and the movable electrode 103. By applying a voltage between the signal transmitting fixing electrode 105 and the movable electrode 103 that are arranged through the silicon oxide film 102 over the high-resistance silicon substrate 101, the movable electrode 103 is placed by an electrostatic force into contact with the electrode-to-electrode isolating silicon oxide film 110 on the signal transmitting fixed electrode 105, leaving only part of the capacitance reducing space 109 at or around the movable electrode fixing regions. Even when a voltage is applied between the signal transmitting fixed electrode 105 and the movable electrode 103 to thereby place the movable electrode 103 in contact with the fixed electrode 105, the electrode-to-electrode isolating silicon oxide film 110 on the signal transmitting electrode 105 prevents the movable electrode 103 from being disconnected due to a potential difference impossible to be held due to direct contact between the fixed electrode 105 and the movable electrode 403.

The signal transmitting fixed electrode 405 and the movable electrode 104 form a capacitance that is to follow Equation 1. This is a series-connection capacitance of a capacitor capacitance comprising the electrode-to-electrode isolating silicon oxide film 110, expressed by Equation 2, and a capacitor capacitance comprising the capacitance reducing space, expressed by Equation 3.

$$1/C=1/C_{OX}+1/C_{Air} \quad \text{Equation 1}$$

$$C_{OX}=\epsilon_s\epsilon_0 S/t \quad \text{Equation 2}$$

$$C_{Air}\epsilon_0 S/d \quad \text{Equation 3}$$

In Equations 2 and 3, $\epsilon_s$ is the relative dielectric constant of the silicon oxide film, $\epsilon_0$ is the dielectric constant in vacuum, S is the area of an electrode formed by the signal transmitting fixed electrode and movable electrode, t is the thickness of the electrode-to-electrode isolating silicon oxide film, d is the length of the capacitance reducing space 409, and t is generally a value of one-tenth of d or less. Exactly speaking, Equation 3 is on a capacitor capacitance in a vacuum, but it takes nearly the same in air. When the movable electrode 403 is in contact with the signal transmitting fixed electrode 405, the capacitor capacitance formed by the capacitance reducing space 409 is a negligible value. Thus, it can be considered without problem that there exists only a capacitor capacitance of the electrode-to-electrode isolating silicon oxide film 410. Meanwhile, when the movable electrode 403 is in a position keeping a predetermined capacitance reducing space 409 away from the signal transmitting fixed electrode 405, the capacitor capacitance is predominantly based on the capacitance reducing space.

Figure 6:
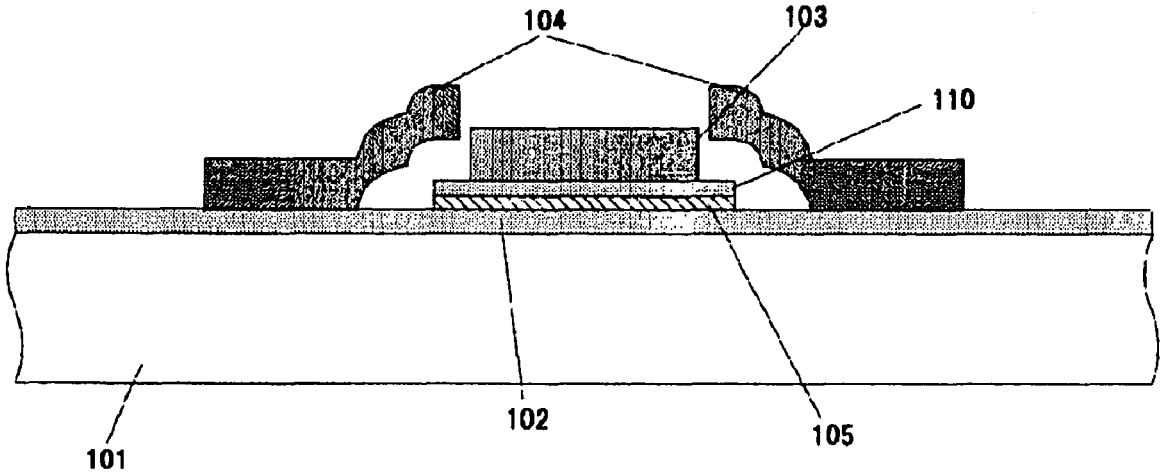
FIG. 6 is a sectional view showing a connection state of the switch in the section B–B' in FIG. 2.

FIG. 6 is a sectional view along line B–B' in FIG. 2, showing a state that there is a connection between the signal transmitting fixed electrode 105 and the movable electrode 103. By applying a voltage between the signal transmitting fixing electrode 105 and the movable electrode 103 arranged through the silicon oxide film 102 over the high-resistance silicon substrate 101, the movable electrode 103 is placed, by an electrostatic force, into contact with the electrode-to-electrode isolating silicon oxide film 110 on the signal transmitting fixed electrode 105, increasing the distance between the movable electrode driving fixed electrode 504 and the movable electrode 103 by a predetermined capacitance reducing space.

The operation from a state of connection between the signal transmitting fixed electrode 105 and the movable electrode into a state of disconnection between them is as follows. Namely, the voltage applied between the signal transmitting fixed electrode 105 and the movable electrode 103 is rendered zero, and a voltage is applied between the movable electrode 103 and the movable electrode driving fixed electrode 104. Due to this, an electrostatic force acts to reduce to zero the distance of a predetermined capacitance reducing space caused between the movable electrode driving fixed electrode 504 and the movable electrode 103. As a result, besides the spring force by which the movable electrode 103 is to return from a deformation, the electrostatic force acts to move the movable electrode 103. This enables the movable electrode 103 to leave from the signal transmitting fixed electrode 105 in a brief time, obtaining an effect of improving the disconnecting characteristic.

Figure 7:
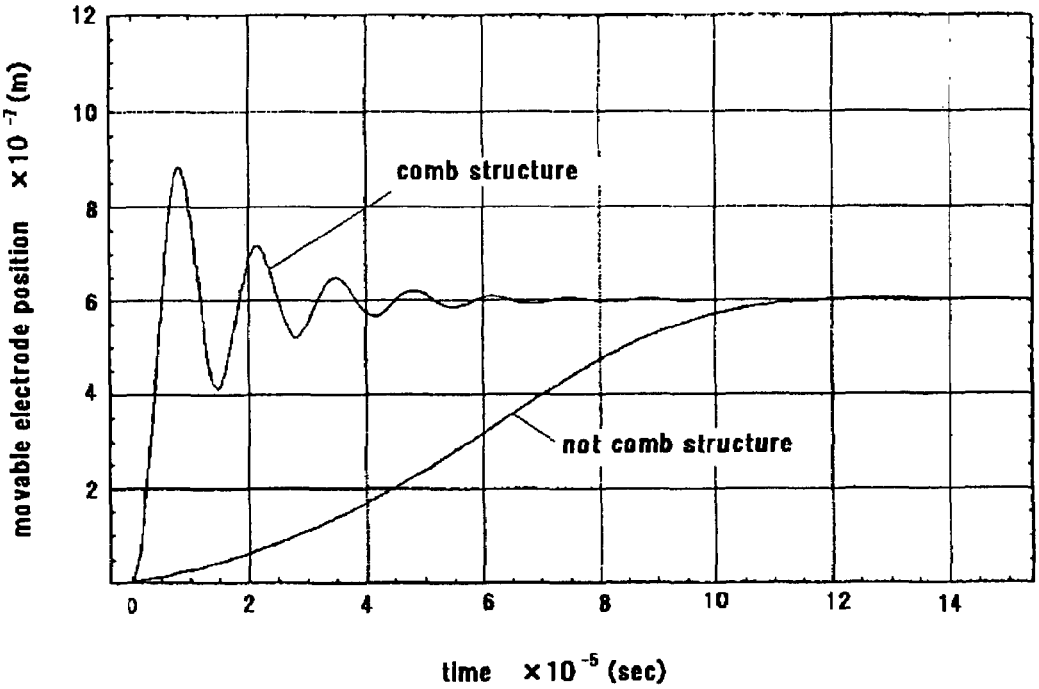
FIG. 7 is a characteristic diagram showing a response characteristic difference in the presence/absence of a switch comb structure in the embodiment 1 of the invention.

FIG. 7 shows a response characteristic for the case that, for example, the movable electrode 103 has a width of 5 $\mu$m, a length of 400 $\mu$m and a thickness of 0.7 $\mu$m, wherein the gap between the movable electrode 103 and the signal transmitting fixed electrode 105 is 0.6 $\mu$m. FIG. 7 shows a manner in which from a state of contact between the movable electrode 103 and signal transmitting fixed electrode 105, an electrostatic force is put off at time 0 and the fixed electrode 105 is returned to the former position. For reference, shown together is a case that the movable electrode 103 is in the same form but has no comb fingers.

Figure 8:
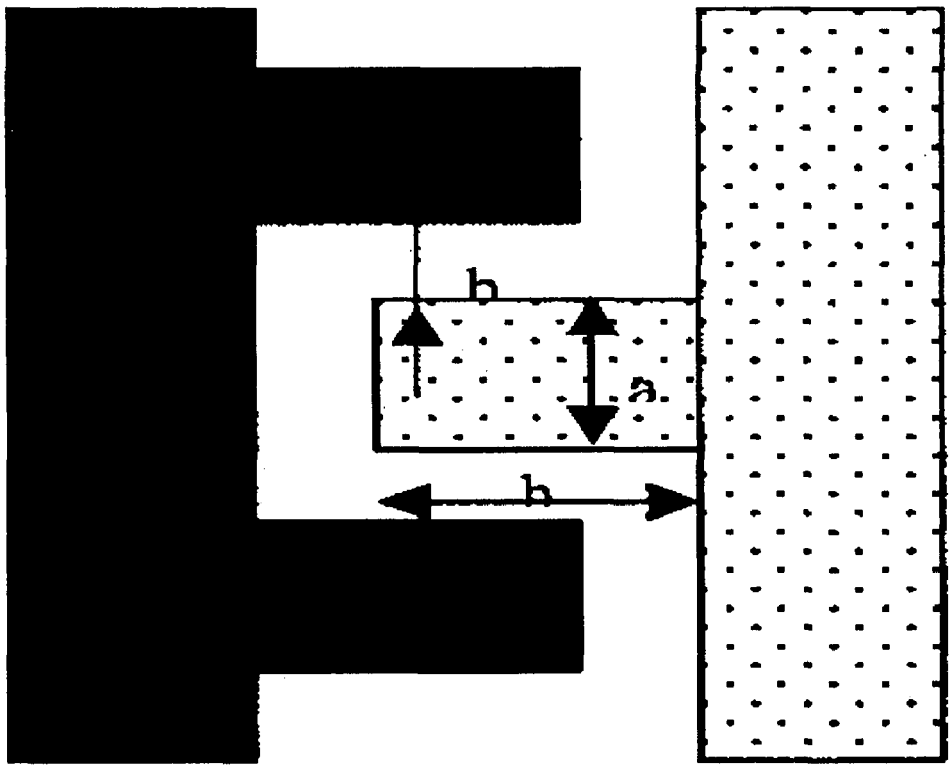
FIG. 8 is a concept view showing a parameter representing a shape of the switch comb structure in the embodiment 1 of the invention.

FIG. 8 shows an enlarged view depicting the comb finger. The comb has a finger width a of 1 $\mu$m, a finger height h of 5 $\mu$m, and a finger-to-finger distance of 1 $\mu$m. In the absence of a finger structure, because the movable electrode 103 is returned to the former position by only a spring force thereof, it naturally has a longer response time. In the fingered structure, in applying a voltage between the movable electrode 103 and the movable electrode driving fixed electrode 105, an electrostatic force is additionally applied to the movable electrode to returning it to the former position. Thus, a much higher response is available.

Incidentally, although in the embodiment 1 the switch parts are arranged over the high-resistance silicon substrate through a silicon oxide film, another insulation material, e.g. a silicon nitride film, maybe used. Also, although the high-resistance silicon substrate was used, the similar effect is obtainable even if using a material other than silicon, e.g. a compound semiconductor substrate such as a gallium-arsenic substrate, or an insulation substrate of quartz, alumina or the like. Furthermore, where the substrate has an electric resistance high enough not to cause an electric affection between the movable electrode, the signal transmitting fixed electrode and movable electrode driving fixed electrode, the silicon oxide film or the equivalent insulation materials can be omitted.

Meanwhile, embodiment 1 of the invention in FIG. 2 has the rectangular concave and convex parts formed in the side surface of the movable member as well as the rectangular concave and convex parts formed in the movable electrode driving fixed electrode. The corners of those, if made in a form having a curvature, provide the similar effect.

2. Second Exemplary Embodiment

The force acted upon the electrodes having a combination of convex and concave parts is described, e.g. in IEEE MEMS 2002 Tech. Dig., p532, 2002. In the case of displacement-z, the force acted in a z-direction is given by Equation 4.

$$F_z=\partial(CV^2/2)/\partial z \qquad \text{Equation 4}$$

Figure 9:
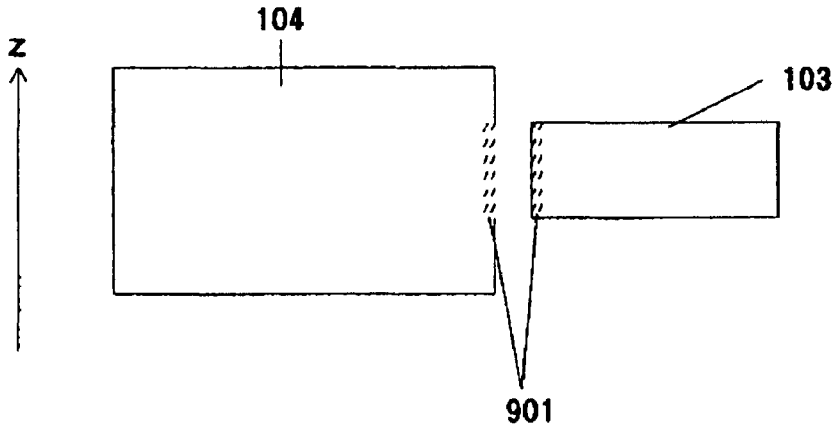
FIG. 9 is an illustrative view showing a capacitance formed between electrodes when the invention is not applied.

In equation 4, V is the application voltage to the electrode, C is the capacitance formed between the electrodes, and z is given as a displacement. From Equation 4, it can be seen that, even where there is no capacitance change formed between the electrodes when there is a displacement change in the z-direction, an electrostatic force does not takes place. Accordingly, in the case that, for example, the movable electrode driving fixed electrode 104 is greater than the movable electrode 103 in thickness as shown in FIG. 9, the capacitance region 901 in the movable electrode driving fixed electrode 104 and movable electrode 103 is not changed in area by a somewhat movement of the movable electrode 103 in the z-direction, causing no force in the z-direction. Within the range of the film thickness of the movable electrode driving fixed electrode 104, the driving by the electrostatic force is impossible.

In the case that the movable electrode 103 has a film thickness of tm, the movable electrode driving fixed electrode has a film thickness of td and the both is in a relationship of td>tm, then there exists an uncontrollable position lu, i.e. lu=td−tm.

Meanwhile, the movable electrode driving fixed electrode 104 and the movable electrode 103 are made in the same film thickness, there is no uncontrollable position lu. The movable electrode 103 can be controlled always in a constant position by applying a voltage and adding an electrostatic force between the movable electrode driving fixed electrode 601 and the movable electrode 103.

3. Third Exemplary Embodiment

Figure 10A:
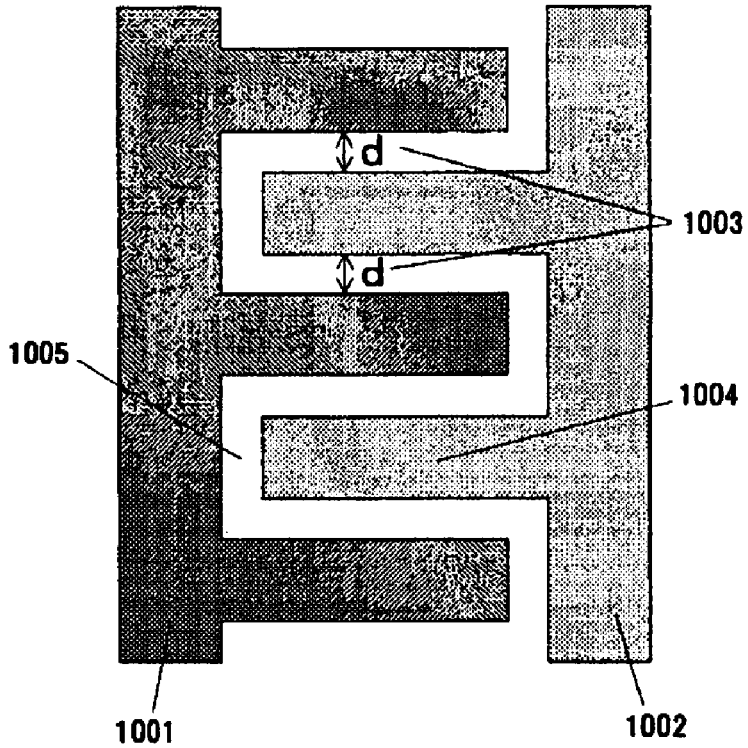
FIG. 10A is an illustrative view showing positions of a movable electrode and movable electrode driving fixed electrode on the switch in embodiment 3 of the invention.
Figure 10B:
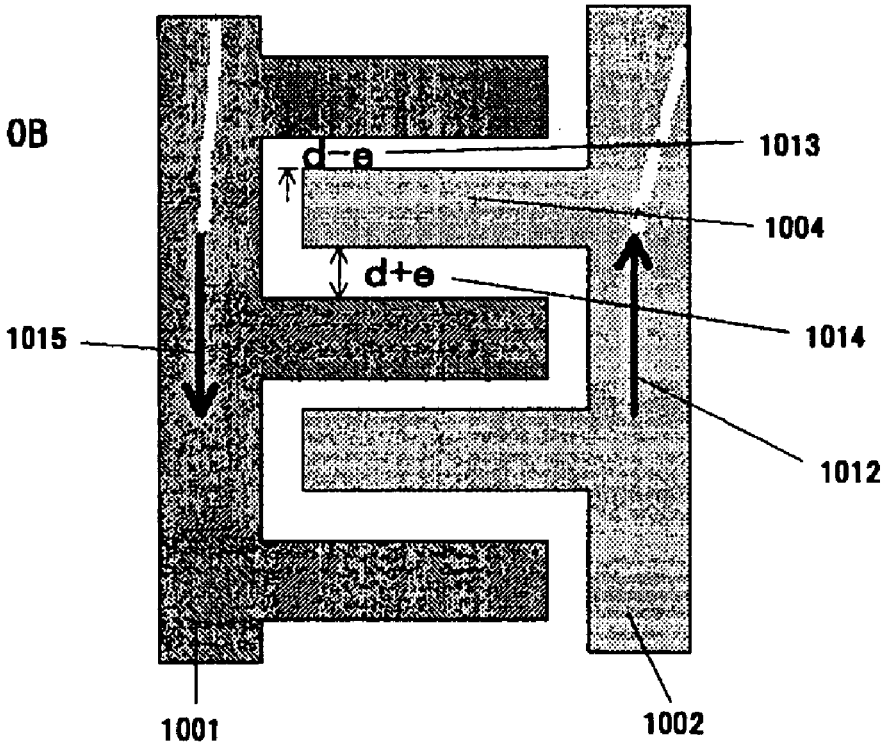
FIG. 10B is an illustrative view showing positions of the movable electrode and movable electrode driving fixed electrode and an electrostatic force acted thereon when the switch is formed without applying the invention.

As shown in FIG. 10A, the convex part 1004 on the side surface of the movable electrode 1002 and the concave part 1005 of the movable electrode driving fixed electrode 1001 have a predetermined gap 1003 having an even distance d between them. However, in the case the movable electrode 1002 and the movable electrode driving fixed electrode 1001 are formed through the use of different masks, when a misfit occurs between the mask for forming a movable electrode and the mask for forming a movable electrode driving fixed electrode, the result is as shown in FIG. 10B. Namely, the gap on one side between the convex part 1004 on the side surface of the movable electrode and the concave part 1005 of the movable electrode driving fixed electrode 1001 is narrowed into d−e, i.e. a narrow gap 1013. The gap between the concave part 1005 and the concave part 1005 on opposite side is broadened into d+e, i.e. a wide gap 1014. Namely, FIG. 10B shows a relationship between the convex part 1004 of the movable electrode 1002 and the concave part 1005 of the movable electrode driving fixed electrode 1001 in the case a mask misfit takes place by a distance e in an upper direction in the figure.

It is known that, where such a mask misfit takes place, when a voltage is applied between the movable electrode 1002 and the movable electrode driving fixed electrode 1001 to thereby generate an electrostatic force, the electrostatic attractive force acts vertically in the figure. Concerning the magnitude of the electrostatic attractive force, there is a description in IEE MEMS 1996 Tech. Dig., p.216, 1996. Thus, an attractive force 1012 acts toward the movable electrode in a magnitude expressed in Equation 5 and an attractive force 1015 acts toward the movable electrode driving fixed electrode 1001. When an electrostatic force is generated exceeding the force determined from a spring constant of the movable electrode 1002, the movable electrode 1002 is placed into a contact with the movable electrode driving fixed electrode 1001. This causes a problem that the movable electrode 1002 is broken besides being impeded in movement. However, by applying this embodiment to form the movable electrode 1002 and movable electrode driving fixed electrode 1001 through the same mask, a mask misfit can be reduced to zero.

$$F(x)=-(V^2/2)\partial C/\partial x=(n/2)hl\epsilon_0 \{1/(d-e-x)^2-1/(d+e+x)^2\}V^2 \quad \text{Equation 5}$$

Where, C is the capacitance formed by the movable electrode driving fixed electrode and the movable electrode, X is the force caused at a point moved a distant x from a mask misfit position, V is the application voltage to between the movable electrode driving fixed electrode and the movable electrode, n is the number of convex parts in the movable electrode, h is the smaller film thickness of the movable electrode driving fixed electrode and the movable electrode, l is the overlapped length of the both convex parts of the movable electrode driving fixed electrode and the movable electrode, $\epsilon_0$ is the dielectric constant in the air, d is the design value of a predetermined gap of each convex part of the movable electrode driving fixed electrode and the movable electrode and the adjacent concave part, and e is the misfit amount in mask registration.

4. Fourth Exemplary Embodiment

Figure 11A:
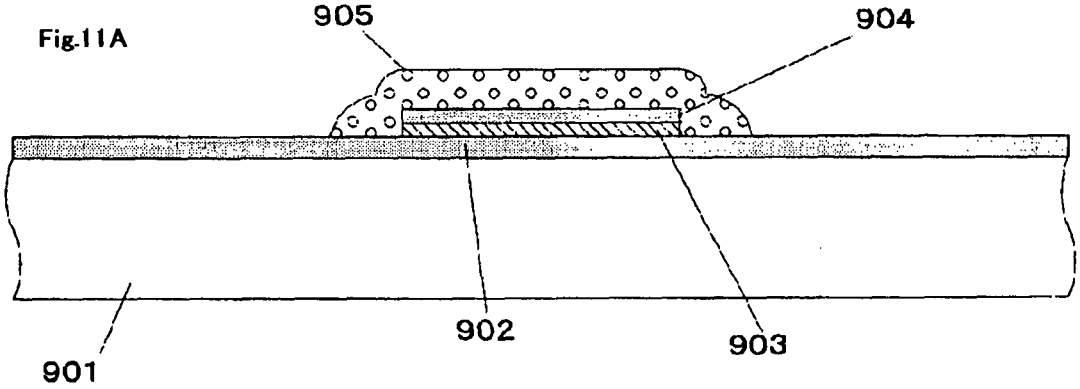
FIGS. 11A–11C are sectional views showing a switch manufacturing process in embodiment 4 of the invention.
Figure 11B:
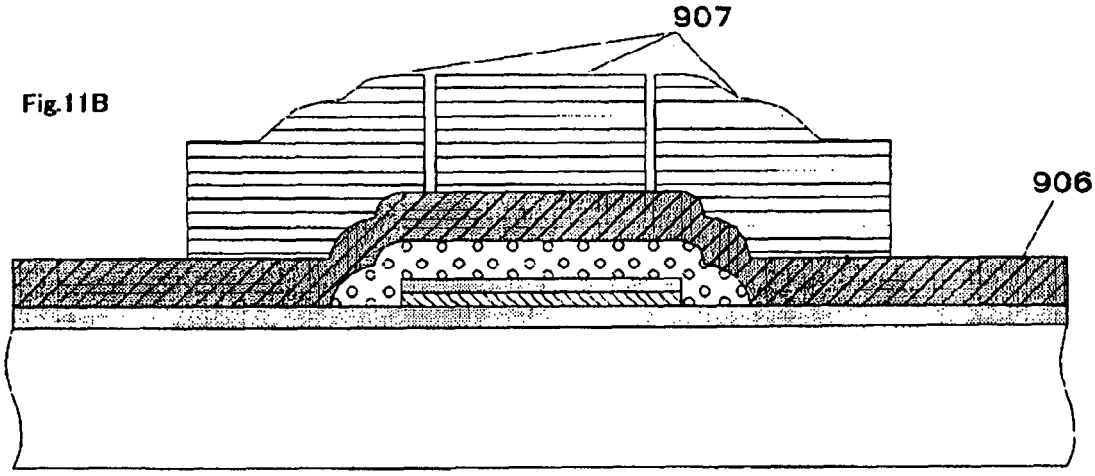
Figure 11C:
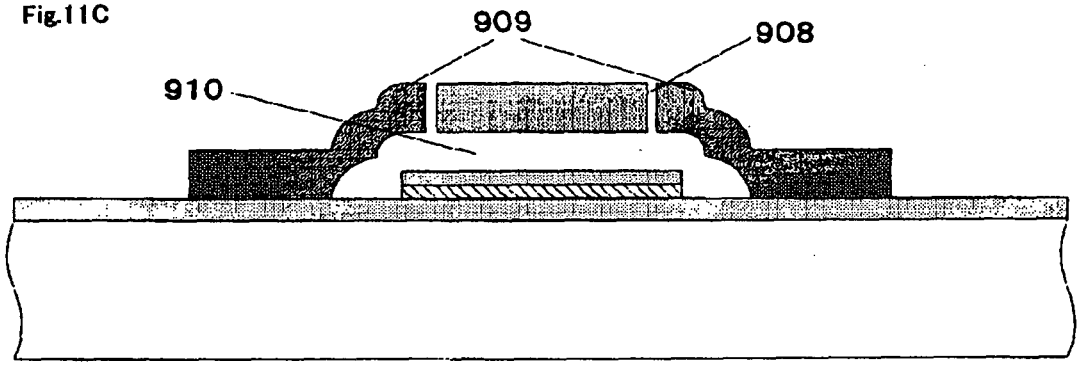

FIG. 11 is a sectional view showing a manufacturing process for a switch according to the invention. In FIG. 11A, a high-resistance silicon substrate 901 is thermally oxidized to form a silicon oxide film 902 on the high-resistance silicon substrate 901. Thereafter, a metal layer for making a signal transmitting fixed electrode 903 is formed on the silicon oxide film 902, on which is formed a silicon oxide film for making an electrode-to-electrode isolating silicon oxide film 904. Thereafter, a photoresist pattern is formed by photolithography in such a manner that the resist only in a predetermined area is left, to dry-etch the silicon oxide film on the metal using the photoresist as a mask. Subsequently, the metal is etched to thereby form a signal transmitting fixed electrode 903 and an electrode-to-electrode isolating silicon oxide film 904. Furthermore, after removing the resist mask, a sacrificial layer material is deposited and patterned such that a sacrificial layer is left on the movable electrode, convex and concave parts in a side surface of the movable electrode, convex and concave parts of a movable electrode driving fixed electrode, and an area partly adjacent the concave and convex parts of the movable electrode driving fixed electrode, thereby forming a sacrificial layer 905. Thereafter, as shown in FIG. 11B, metal 906 is formed over the entire surface. Then, a resist mask 907 is formed in a predetermined area to arrange a movable electrode and movable electrode driving fixed electrode.

Figure 1A:
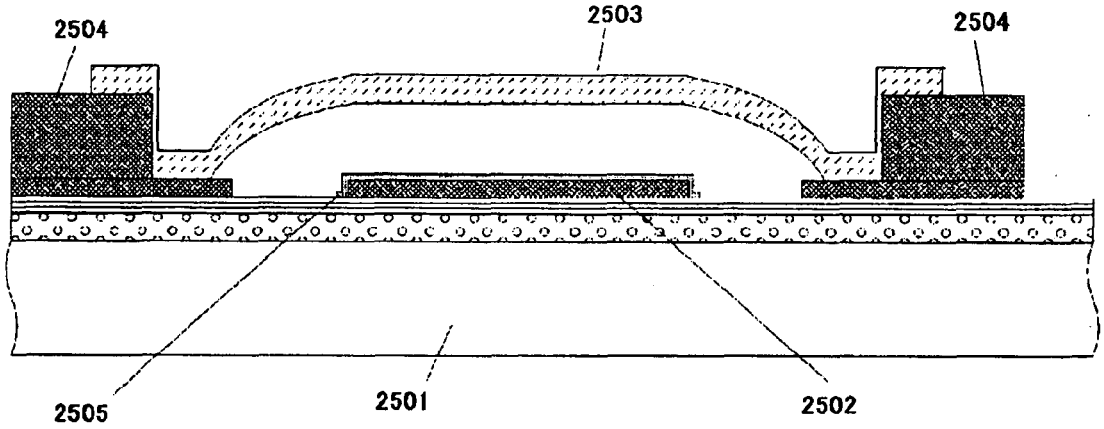
FIGS. 1A and 1B are sectional views showing one example of a conventional switch.
Figure 1B:
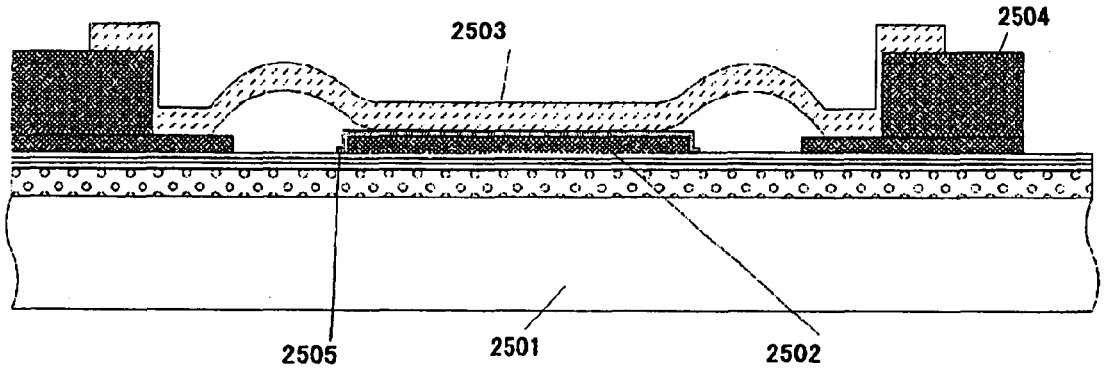

Thereafter, as shown in FIG. 1C, the metal is etched using the resist mask 907 as a mask, to form a movable electrode 908 and movable electrode driving fixed electrode 909. Furthermore, after removing the resist mask 907, the sacrificial layer 905 is removed away, thereby forming a capacitance reducing gap 910.

Incidentally, although this embodiment used a metal as a material of a signal transmitting fixed electrode, movable electrode and movable electrode driving fixed electrode, alternatively may be used a semiconductor doped with an impurity at high concentration, a conductive polymer material or the like.

Meanwhile, although a silicon oxide film was used as an insulation film on the high-resistance silicon substrate 901, the substrate may be of another insulative material similarly to embodiment 1. Similarly, it is possible to use another substrate material, such as a gallium-arsenic substrate. Furthermore, it is needless to say that, where the substrate has a sufficiently high resistance, the silicon oxide film may be eliminated.

5. Fifth Exemplary Embodiment

Figure 12A:
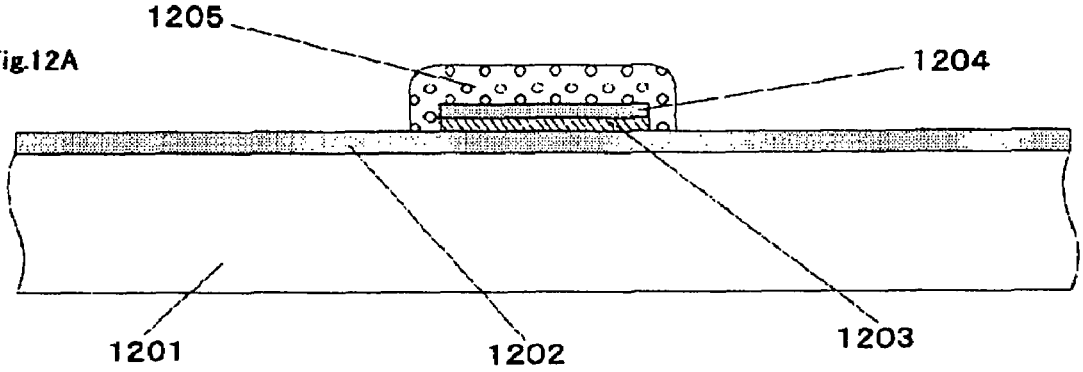
FIGS. 12A–12C are sectional views showing a switch manufacturing process in embodiment 5 of the invention.
Figure 12B:
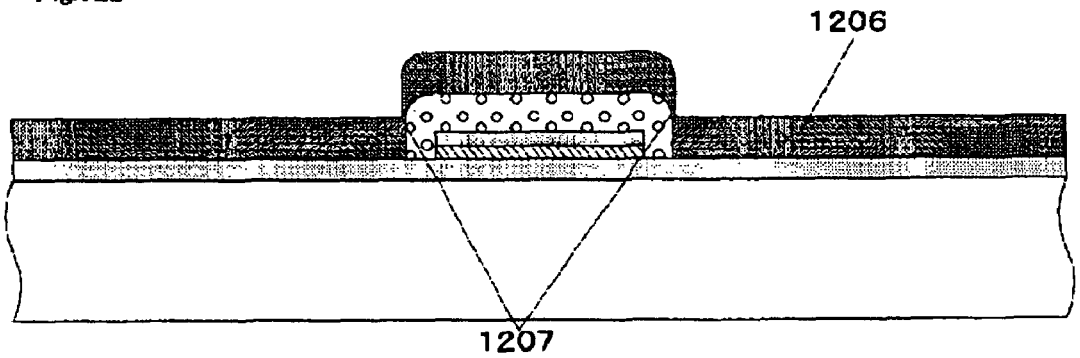
Figure 12C:
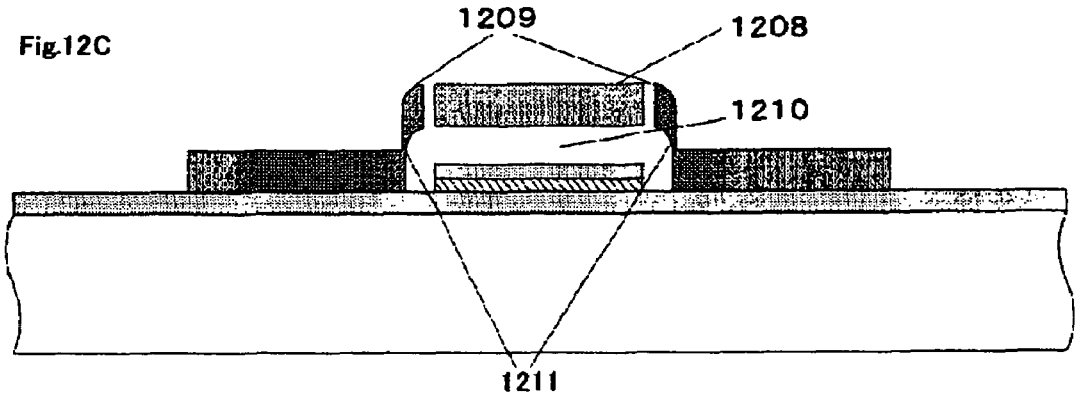

FIG. 12A shows a sectional view in a manufacturing process for a switch in the case a step modulating pattern is not formed. On a high-resistance silicon substrate 1201, formed are a silicon oxide film 1202, a signal transmitting fixed electrode 1203 and an electrode-to-electrode isolating silicon oxide film 1204, by the process similar to that of the embodiment 4. Then, formed is a sacrificial layer 1205 of polyimide. Differently from the embodiment 4, the present embodiment has the sacrificial layer 1205 designed with a small width so that the sacrificial layer 1205 can be easily removed. Thereafter, an Al film 1206 is formed over the entire surface by sputtering, as shown in FIG. 12B. The sputtering technique can stably form an Al film even in a process at a comparatively low temperature. However, there is a feature that deposition is not easy on the side surface of a step. In the evaporation technique, deposition is not easy on the side surface of a step. Meanwhile, where a CVD process is used in a low-pressure atmosphere, deposition is possible on the step side surface, but there is a limitation in application scope because of its high process temperature. Accordingly, the Al film is formed with a thickness-reduced region 1207 at a step. Thereafter, as shown in FIG. 12C, a resist mask is formed in a predetermined area where a movable electrode and movable electrode driving fixed electrode are arranged. The Al is etched using the resist mask as a mask, to form a movable electrode 1208 and movable electrode driving fixed electrode 1209. Furthermore, by removing away the resist mask and sacrificial layer 1205, a capacitance reducing space 1210 is formed. On the other hand, the thickness-reduced area at the step of the sacrificial layer 1205 is left, as it is, as a strength-deficient region 1211 of the movable electrode driving fixed electrode 1209.

FIG. 13 shows a sectional view in a manufacturing process for a switch in the case a step modulating pattern for step coverage compensation is formed. In FIG. 13A, a silicon oxide film 1202, a signal transmitting fixed electrode 1203 and an electrode-to-electrode isolating silicon oxide film 1204 are formed on a high-resistance silicon substrate 1201, by a process similar to that of the embodiment 4. Next, as shown in FIG. 13B, photoresist is spin-coated. This is exposed to light and developed, and then baked on a hot plate, thereby forming a step modulating pattern 1212 in a predetermined area. The step-modulating pattern 1212 is formed in such a position and film thickness that a step formed by a movable electrode driving fixed electrode in a later process and by the sacrificial layer can be divided.

Figure 13A:
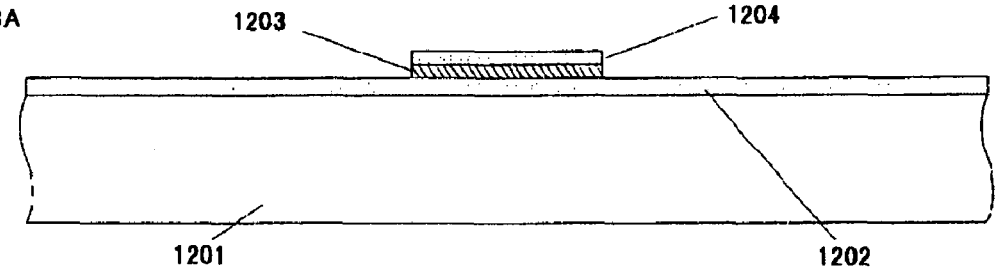
FIGS. 13A–13E are sectional views showing a switch manufacturing process without applying a step modulating pattern of FIGS. 12A–12C.
Figure 13B:
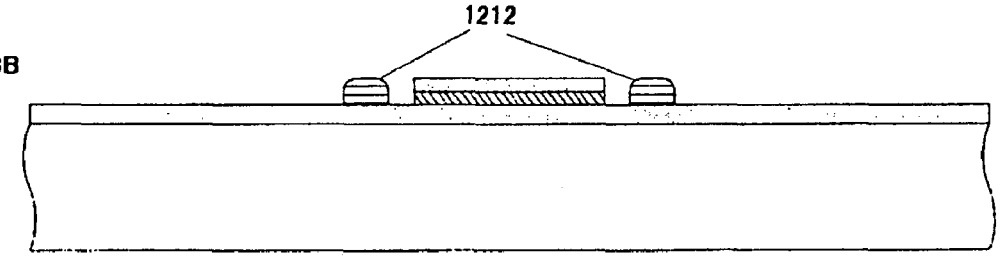
Figure 13C:
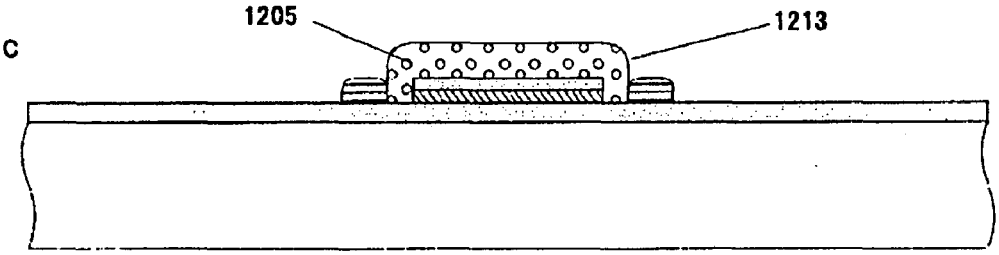
Figure 13D:
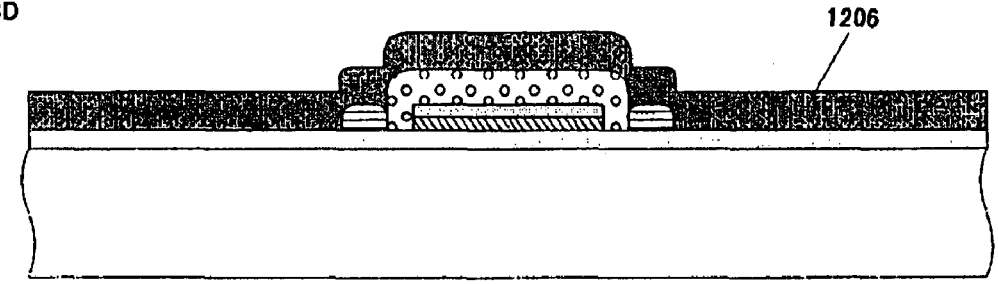
Figure 13E:
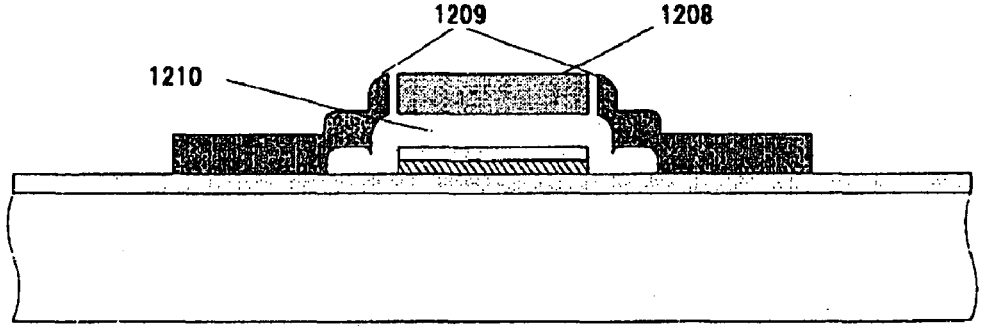

Subsequently, as shown in FIG. 13C, formed is a sacrificial layer 1205 of polyimide. The step-modulating pattern 1212 exists outside of the sacrificial-layer end surface 1213. In the absence of the step modulating pattern 1212, a step having a length from a sacrificial layer 1205 surface to the silicon oxide film 1202 surface is formed at the end surface of the sacrificial layer. On the contrary, by the step modulating pattern 1212, the step is divided into two, i.e. a step from the sacrificial layer surface to the step modulating pattern surface and a step from the step modulating pattern surface to the silicon oxide film surface. This makes it possible to prevent a great step from being formed at one point. Thereafter, as shown in FIG. 13D, an Al film 1206 is formed over the entire surface by sputtering. Furthermore, as shown in FIG. 13E, a resist mask is formed in a predetermined area where a movable electrode and a movable electrode driving fixed electrode are arranged, by a process similar to that of the embodiment 4. The Al is etched using the resist mask as a mask, to form a movable electrode 1208 and a movable electrode driving fixed electrode 1209. Furthermore, by removing the resist mask, the sacrificial layer and the step modulating pattern, a capacity reducing space 1210 is formed. Because the step in the sacrificial layer for the capacity reducing space is moderated by the both of the sacrificial layer and the step modulating pattern, in the movable electrode driving fixed electrode 1110, a strength deficient region of an extremely small film thickness is not formed.

In-the process using an oxygen plasma process, processing is possible in a low pressure atmosphere, differently from the wet etching in a solvent. As for the adsorption in a liquid process, there is a description, e.g., in J. Vac. Sci. Technol., Vol. B, P. 1, 1997. It is known that, in the drying process, there possibly occurs an adsorption of an unintended region under the influence of a surface tension or the like. Accordingly, the use of a sacrificial layer consisting of a resist makes it possible to eliminate the need of carrying out an in-liquid process after removing the sacrificial layer. This can prevent an adhesion between the movable electrode and the signal transmitting fixed electrode.

Incidentally, although as the step modulating pattern of the embodiment, photoresist is used, polyimide may be used without any problem. Furthermore, in the embodiment, as the step modulating pattern the material to be removed away by a sacrificial layer removal process is used. In the case of a material not to be removed by a sacrificial later removal process, the movable electrode driving fixed electrode has a further increased strength.

6. Sixth Exemplary Embodiment

FIG. 14 shows a sectional view in a manufacturing process for a switch in the case a step modulating pattern is formed on the both sides of the signal transmitting fixed electrode in a shorter-side direction thereof, showing a section along line A–A' in FIG. 2. In FIG. 14A, a silicon oxide film 102, a signal transmitting fixed electrode 105 and an electrode-to-electrode isolating silicon oxide film 1304 are formed on a high-resistance silicon substrate 101, by a process similar to that of the embodiment 4.

Figure 14A:
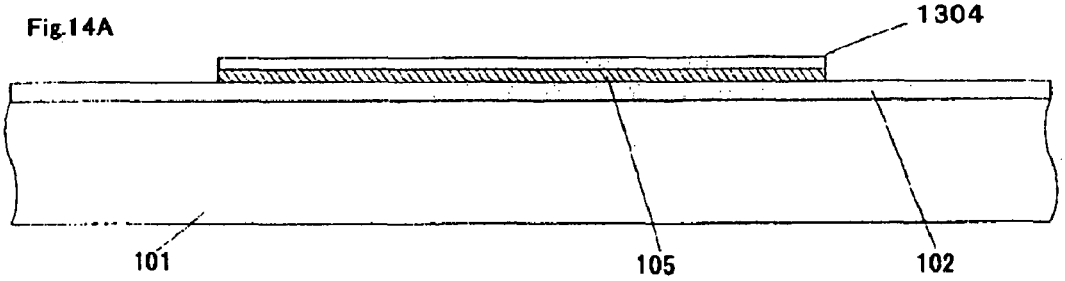
FIGS. 14A–14E are sectional views showing a switch manufacturing process to form a step modulating pattern in a shorter-side directional side surface of a signal transmitting fixed electrode, in embodiment 6 of the invention.
Figure 14B:
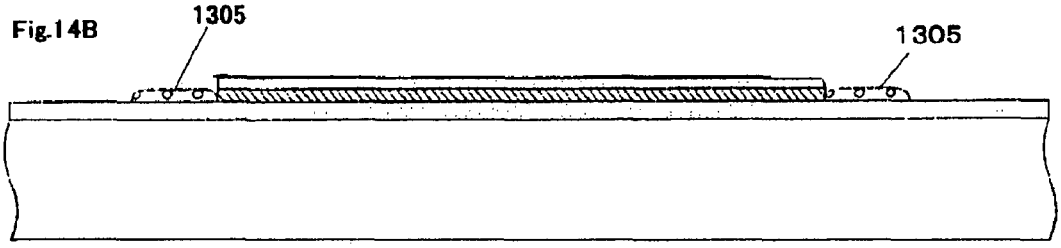
Figure 14C:
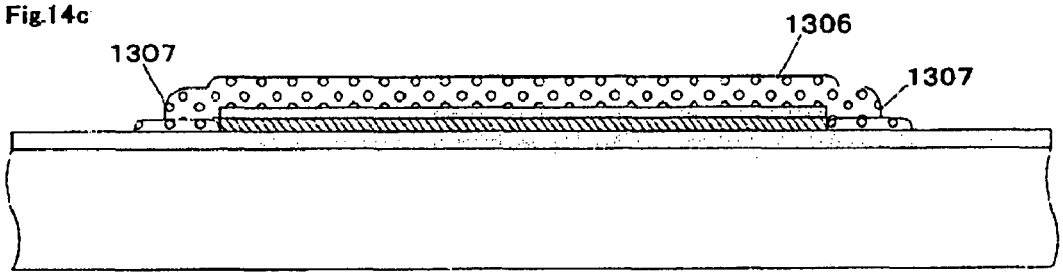
Figure 14D:
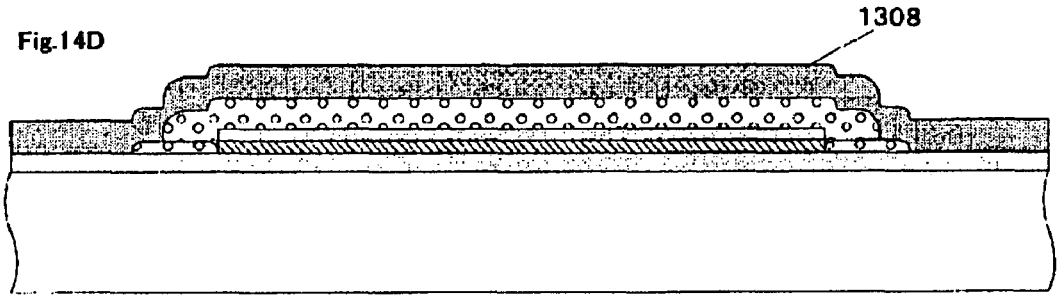

Next, as shown in FIG. 14B, photosensitive polyimide is spin-coated on the both sides of the signal transmitting fixed electrode in a shorter-side direction thereof. After exposure to light and development, baking is done on a hot plate, thereby forming a step moderating pattern 1305. The step moderating pattern 1305 is formed in such a position and film thickness that a step formed by a movable electrode and a sacrificial layer in the later process can be divided. Subsequently, as shown in FIG. 14C, a polyimide sacrificial layer 1306 is formed. Because the step moderating pattern 1305 exists beneath the sacrificial layer end surface 1307, the step from the sacrificial layer surface is divided into a plurality of sub-steps, thus making it possible to prevent a great step from being formed at one point. Thereafter, as shown in FIG. 14D, an Al film 1308 is formed on the entire surface by sputtering process. This, although can be deposited at a comparatively low temperature similarly to the embodiment 5, has a feature not ready to deposit at a step side surface. In the evaporation process, there is a similar feature.

Figure 14E:
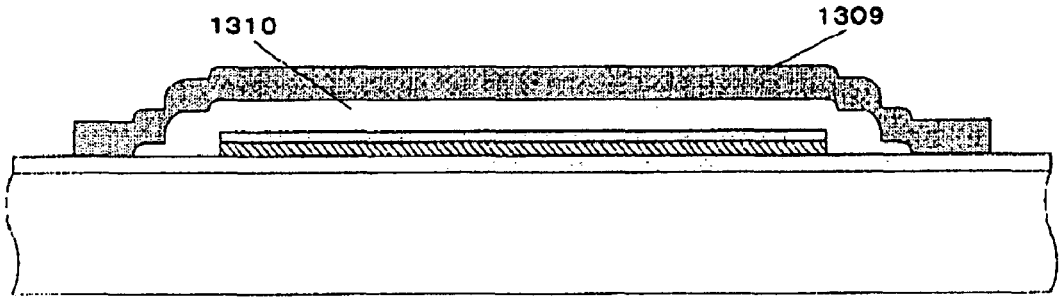

Furthermore, as shown in FIG. 14E, a resist mask is formed in a predetermined area where a movable electrode is arranged, by the process similar to that of the embodiment 4. The Al is etched using the resist mask as a mask, to form a movable electrode 1309. Furthermore, by removing away the resist mask, sacrificial layer and step modulating pattern, a capacitance reducing space 1310 is formed. Because the step in the sacrificial layer for the capacity reducing space is moderated by the both of the sacrificial layer and the step modulating pattern, the movable electrode 1309 is not formed with a strength deficient region of an extremely small film thickness. Incidentally, although the step modulating pattern in this embodiment was formed of polyimide, it is not problematic, similarly to embodiment 5 if is left after a sacrificial layer removal process.

FIG. 15 shows a sectional view in a manufacturing process for a switch in the case a step modulating pattern is formed on the both sides of the signal transmitting fixed electrode in a longer-side direction thereof, showing a section along line B–B' in FIG. 2. In FIG. 15A, a silicon oxide film 102, a signal transmitting fixed electrode 105 and an electrode-to-electrode isolating silicon oxide film 1304 are formed on a high-resistance silicon substrate 101, by a process similar to that of embodiment 4.

Figure 15A:
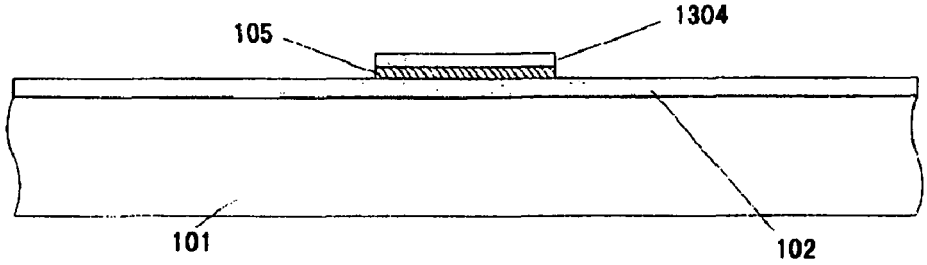
FIGS. 15A–15E are sectional views showing a switch manufacturing process to form a step modulating pattern in a longer-side directional side surface of a signal transmitting fixed electrode, in embodiment 6 of the invention.
Figure 15B:
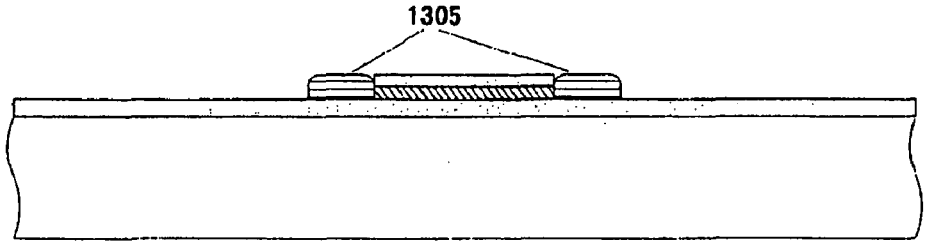

Next, as shown in FIG. 15B, photoresist is spin-coated. After exposure to light and development, baking is done on a hot plate, thereby forming a step modulating pattern 1305 on the both sides of the signal transmitting fixed electrode in a longer-side direction thereof. The step modulating pattern 1305 is formed beneath convex and concave parts in a movable electrode side surface and concave and convex parts in a movable electrode driving fixed electrode which are formed in the later process. The step modulating pattern is formed in a film thickness of adding together of the film thickness of the signal transmitting fixed electrode and the film thickness of the electrode-to-electrode isolating silicon oxide film, in other words, the step modulating pattern has the same height with that of the electrode-to-electrode isolating silicon oxide film with respect to a substrate surface.

Figure 15C:
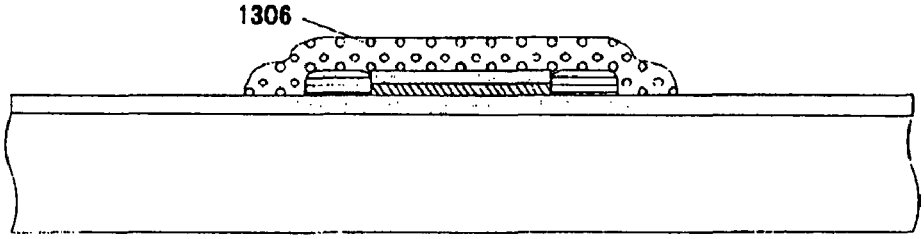

Subsequently, as shown in FIG. 15C, a polyimide sacrificial layer 1306 is formed. By forming the step modulating pattern 1305 in a film thickness of adding together of the film thickness of the signal transmitting fixed electrode 105 and the film thickness of the electrode-to-electrode isolating silicon oxide film 1304, the sacrificial layer has a constant surface height with respect to the substrate surface in the area from the signal transmitting fixed electrode to nearly the end surface of the step modulating pattern 1305.

Figure 15D:
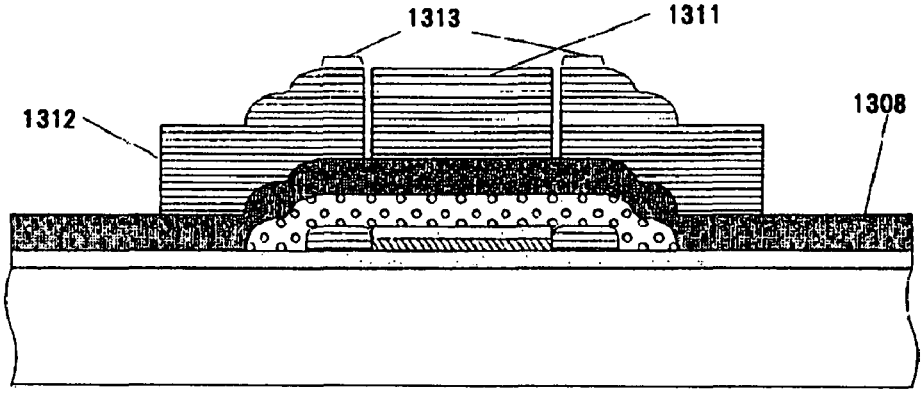

Thereafter, as shown in FIG. 15D, an Al film 1308 is formed on the entire surface by a sputtering process. Furthermore, by a process similar to that of embodiment 4, a photoresist mask 1311 for forming a movable electrode and a photoresist mask 1312 for forming a movable electrode driving fixed electrode are formed in a predetermined position where the movable electrode and movable electrode driving fixed electrode are arranged. The mask for forming the movable electrode driving fixed electrode is partly positioned above the step modulating pattern 1305, to constitute a region 1313 where convex and concave parts of the movable electrode driving fixed electrode are formed. This has the same height as the surface of the movable electrode mask, due to the step modulating pattern 1305.

Although FIG. 15D does not depict the convex and concave parts formed in the movable electrode side surface, those are in the same position as the convex and concave parts formed by the movable electrode driving fixed electrode. As a result, the convex and concave parts of the movable electrode driving electrode and the convex and concave parts formed in the movable electrode side surface are in the same height in their forming regions. As a result, such a fine pattern as not to be formed in a different height due to a printer focus depth problem can be formed as a pattern in the same height, enabling to form a more precise pattern.

Figure 15E:
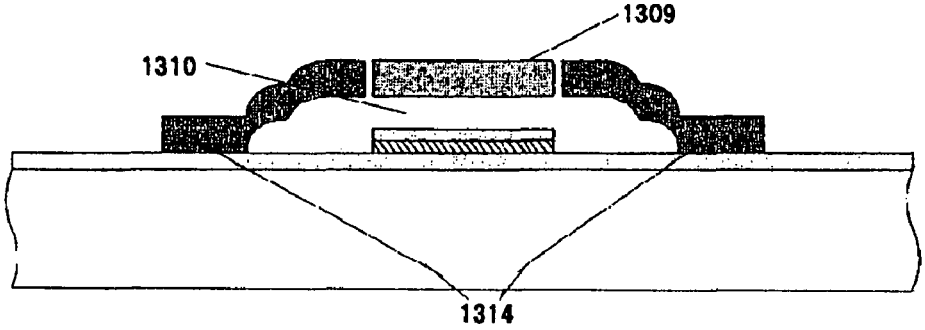

Subsequently, as shown in FIG. 15E, the resist mask is used as a mask, to etch Al thereby forming a movable electrode 1309 and movable electrode driving fixed electrode 1314. Thereafter, by removing the resist mask, the sacrificial layer and the step modulating pattern, a capacitance reducing space 1310 is formed. In this manner, by applying the present embodiment, a finer pattern can be formed in respect of the convex and concave parts in the movable electrode side surface and convex and concave parts in the movable electrode driving fixed electrode.

7. Seventh Exemplary Embodiment

Figure 16:
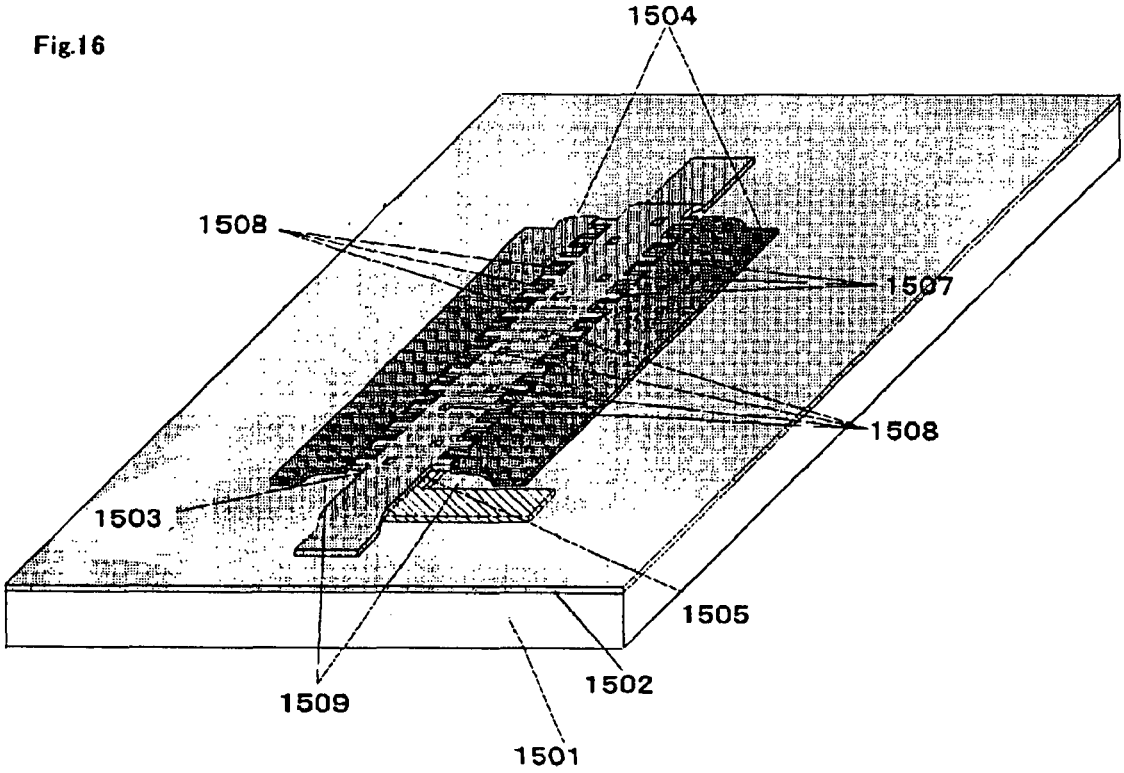
FIG. 16 is a perspective view showing a switch according to embodiment 7 of the invention.

FIG. 16 is a perspective view showing a switch in the case that sacrificial-layer removing holes are formed in a movable electrode. A plurality of sacrificial layer removing holes 1508 are formed on the movable electrode 1503. Where there are no sacrificial layer removing holes, the sacrificial layer can be removed only from a gap formed by the convex an concave parts in the movable electrode side surface and the concave and convex parts of the movable electrode driving fixed electrode 1504 as well as from the both ends 1509 of the movable electrode driving fixed electrode. In order for carrying out a high-speed connection/disconnection on low voltage in an actual switch, there is a need in removing the sacrificial layer to design, at 1 $\mu$m or smaller, a gap defined by the convex and concave parts in the movable electrode side surface and the concave and convex parts of the movable electrode driving fixed electrode 1504, and also, at 1 $\mu$m or smaller, a gap of sacrificial layer at the movable electrode driving fixed electrode both ends 1509. Furthermore, the movable electrode 1503 has a length of approximately 400 $\mu$m. In the case of removing the sacrificial layer from such a narrow region only through a gap formed by the convex and concave parts in the movable electrode side surface and the concave and convex parts of the movable electrode driving fixed electrode 1504 as well as at the both ends of the movable electrode driving fixed electrode, there occurs a problem that the sacrificial layer cannot be completely removed besides consumable time for removing the sacrificial layer is great. By forming the sacrificial layer removing holes on the movable electrode 1503, sacrificial layer can be easily removed. Particularly, this embodiment arranges the movable electrode driving fixed electrode 1504 on a side of the movable electrode. Accordingly, differently from the case there are no obstacles in sacrificial layer removal on the side of the movable electrode, it is more difficult to remove the sacrificial layer if no sacrificial layer removing hole is provided. Meanwhile, the sacrificial layer removing hole, even as small as 1 $\mu$m, provides a sufficient effect. The hole is desirably designed in a size having no effect upon the signal to flow through the movable electrode.

Furthermore, when the switch is operated, after removing the sacrificial layer, the sacrificial layer removing hole 1508 serves as an escape passage for the gas within the gap beneath the movable electrode, in the course of contact of the movable electrode with the signal transmitting fixed electrode. Meanwhile, this serves as a gas entrance in the case that the contacted movable electrode leaves from the signal transmitting fixed electrode. This can prevent the movement of the movable electrode from being impeded due to gas viscosity.

8. Eighth Exemplary Embodiment

Figure 17A:
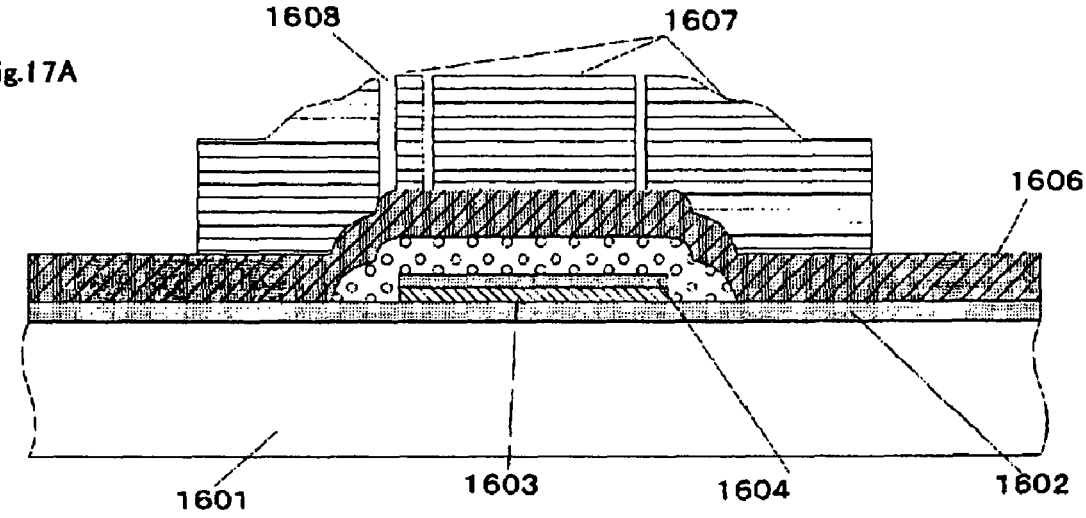
FIGS. 17A–17B are sectional views showing a switch manufacturing process according to embodiment 8 of the invention.
Figure 17B:
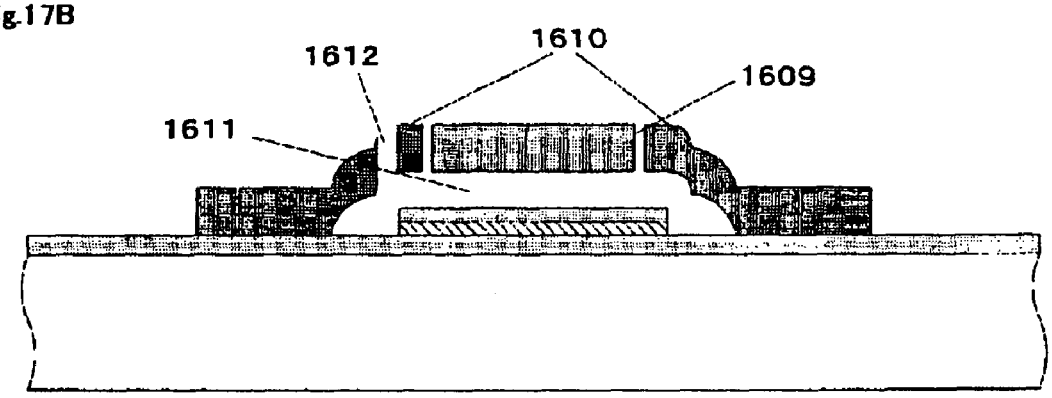

FIG. 17 is a process sectional view showing a switch formed with a sacrificial layer removing hole in the movable electrode driving fixed electrode. By the process similar to that of embodiment 4 of the invention, a silicon oxide film 1602, a signal transmitting fixed electrode 1603, an electrode-to-electrode isolating silicon oxide film 1604 and a sacrificial layer 1605 are formed on a high-resistance silicon substrate 1601. As shown in FIG. 17A, after forming a metal 1606 over the entire surface of the substrate, a resist mask 1607 is formed in a predetermined area where a movable electrode and movable electrode driving fixed electrode are arranged. The resist mask 1607 has a sacrificial layer removing hole forming pattern 1608 for forming sacrificial layer removing holes, in a predetermined area where a movable electrode driving fixed electrode is formed. Thereafter, the metal is etched using the resist mask as a mask, to form a movable electrode 1609 and movable electrode driving fixed electrode 1610. As in FIG. 17B, after removing the resist mask, further removing the sacrificial layer forms a capacitance reducing space 1611. Because the sacrificial layer can be removed also through the sacrificial layer removing holes 1612, the sacrificial layer can be easily removed without being left.

9. Ninth Exemplary Embodiment

Figure 18:
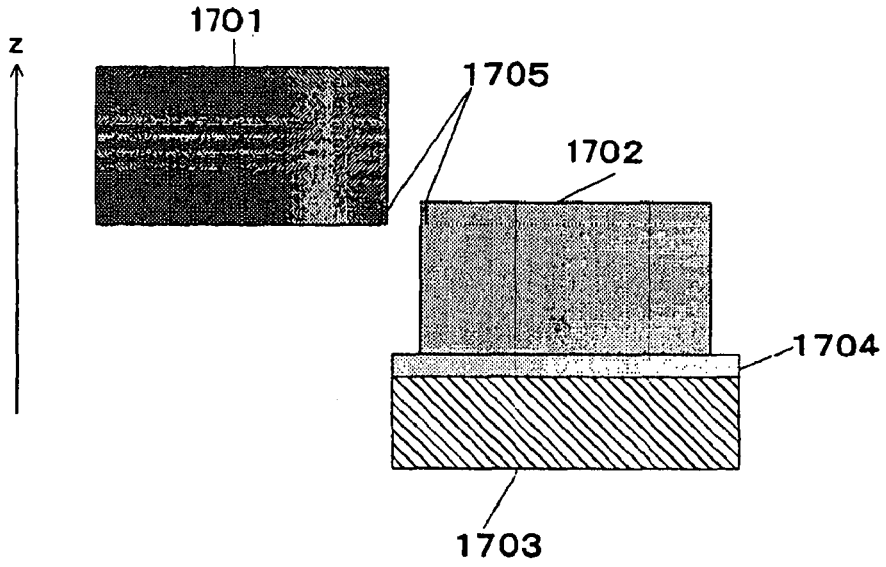
FIG. 18 is an illustrative view showing positions of the switch movable electrode, movable electrode driving fixed electrode, signal transmitting fixed electrode and isolating oxide film.

FIG. 18 is a view illustratively showing the positions of a movable electrode 1702 and movable electrode driving fixed electrode 1701 in the case that the movable electrode 1702 is placed in contact with the signal transmitting fixed electrode 1703 through an isolating oxide film 1704. The movable electrode 1702 even in a state contacted with the signal transmitting fixed electrode 1703 has a vertically overlapped region, thereby forming a parallel-plate capacitance region 1705. In the parallel-plate capacitance region 1705, the electrostatic force generated the case a voltage is applied between the movable electrode driving fixed electrode 1701 and the movable electrode 1702 is determined by Equation 4, similarly to that in embodiment 2. However, in the case that a parallel-plate capacitance is not formed, a force based on Equation 4 does not take place, whereby the force for driving the movable electrode 1702 is considerably small. By thus providing a structure that a plurality of convex and concave parts formed in the movable electrode side surface and those formed in the movable electrode driving fixed electrode 1701 have a vertically overlapped region even in a state that the movable electrode 1702 is in contact with the signal transmitting fixed electrode 1704, a great electrostatic force can be caused.

10. Tenth Exemplary Embodiment

Figure 19:
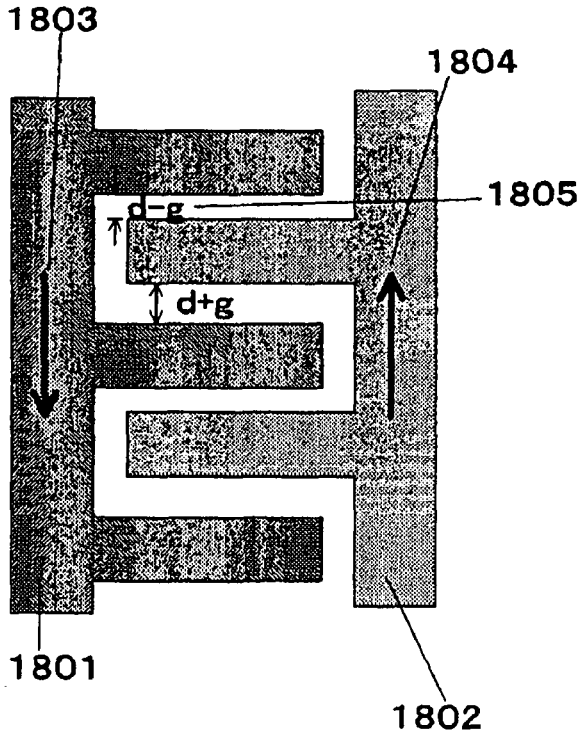
FIG. 19 is an illustrative view showing a relationship between the positions of the movable electrode and movable electrode driving fixed electrode and a force acted between the both electrodes, of a switch according to embodiment 10 of the invention.

FIG. 19 is a view illustratively showing the positions of a movable electrode 1802 and movable electrode driving fixed electrode 1801 when the movable electrode is deviated by g length wisely in the case that the movable electrode is placed in contact with the signal transmitting fixed electrode. The deviated movable electrode makes a normally predetermined gap d formed by the convex part in the movable electrode side surface and the concave part in the movable electrode driving fixed electrode narrower by d−g.

In this state, it is possible to apply a similar thinking way to that of embodiment 3, for the force acting between the movable electrode 1802 and the movable electrode driving fixed electrode 1801. In the case a voltage V is applied between the movable electrode 1802 and the movable electrode driving fixed electrode 1801, a force based on Equation 6 acts on the both electrodes at a point moved by a distance x in an in-plane direction of substrate.

$$F(x)=-(V^2/2)\partial C/\partial x=(n/2)hl\epsilon_0\{1/(d-g-x)^2-1/(d+g+x)^2\}V^2 \quad \text{Equation 6}$$

In the case that a voltage is continuously applied between the movable electrode 1802 and the movable electrode driving fixed electrode 1801, there arises a problem of causing a fracture of the movable electrode 1802 besides the impediment to the movement of the movable electrode 1802 similarly to embodiment 3. However, by reducing the time of applying a voltage between the movable electrode 1802 and the movable electrode driving fixed electrode 1801 to a time or shorter required for a movement in the shortest distance of a predetermined gap formed by the convex part in the movable electrode side surface and the concave part in the movable electrode driving fixed electrode 1801 and a predetermined gap formed by the convex part of the movable electrode driving fixed electrode 1801 and the concave part in the movable electrode side surface, i.e., a distance d−g in this embodiment, it is possible to prevent against the impediment or fracture due to electrode adsorption even when the movable electrode 1802 is placed in contact with the signal transmitting fixed electrode in a length wisely deviated state.

11. Eleventh Exemplary Embodiment

Figure 20A:
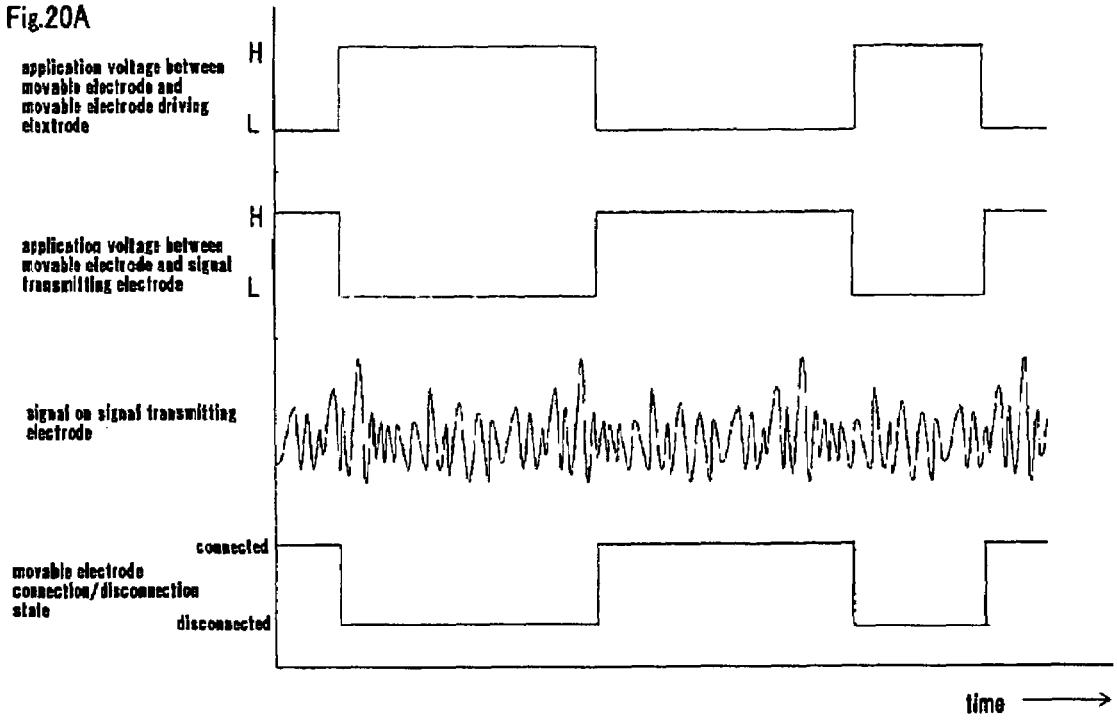
FIG. 20A is a characteristic figure showing a voltage applied between the movable electrode and the movable electrode driving fixed electrode, and between the movable electrode and the signal transmitting fixed electrode a signal flowing through the signal transmitting fixed electrode, and a disconnection state of the movable electrode, of a switch to which the invention is applied.
Figure 20B:
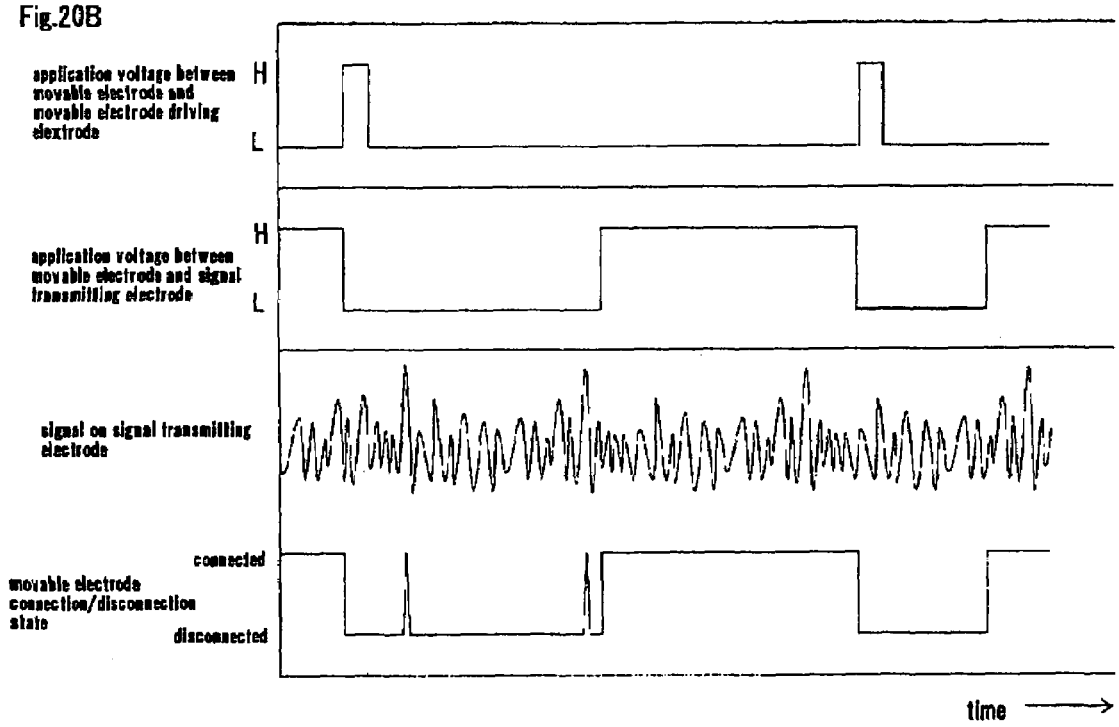
FIG. 20B is a characteristic figure showing a voltage applied between the movable electrode and the movable electrode driving fixed electrode, and between the movable electrode and the signal transmitting fixed electrode, a signal flowing through the signal transmitting fixed electrode, and a disconnection state of the movable electrode, of a switch to which the invention is not applied.

FIG. 20A shows a manner of switch disconnection in the case the invention is applied while FIG. 20B shows a manner thereof in the case where the invention is not applied. Where the invention is applied as shown in FIG. 20A, the movable electrode strays in disconnection even when a great signal is inputted to the transmitting fixed electrode. On the other hand, where the invention is not applied, as shown in FIG. 20B, a voltage is applied between the movable electrode and the movable electrode driving fixed in a pulse form only when a state applying a voltage between the movable electrode and the signal transmitting fixed electrode is changed into a not-applying state. From then on, the movable electrode is kept in the disconnection state even when a voltage is not applied between the movable electrode and the movable electrode driving fixed electrode. However, in the case that a signal flowing to the signal transmitting fixed electrode becomes a certain constant voltage or higher, the movable electrode and the signal transmitting fixed electrode are acted upon by an electrostatic force resulting from the signal. This possibly results in a malfunction, i.e. the movable electrode is in a connection state. In this manner, by applying the present invention, it is possible to prevent the movable electrode from contacting with the signal transmitting fixed electrode due to a signal passing the signal transmitting fixed electrode.

12. Twelfth Exemplary Embodiment

Figure 21:
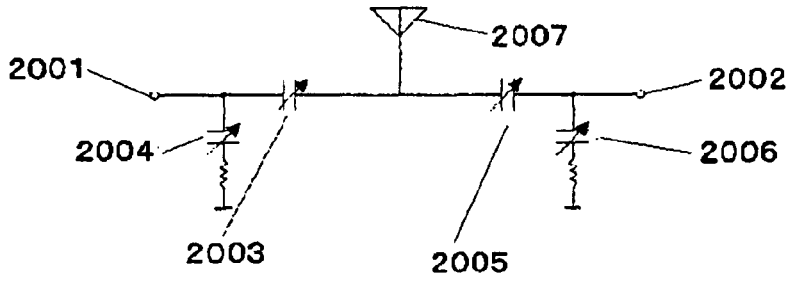
FIG. 21 is a circuit diagram showing an example in which the switch of the invention is applied for receiving and sending a signal from and to an antenna.

FIG. 21 is a circuit example in the case that the switch of the invention is applied as a transmission/reception switch of an antenna. In order to switch over between an antenna 2007, an input-sided amplifier and an output-sided amplifier, series switches 2003, 2005 and grounding switches 2004, 2006 are connected between respective amplifier outputs. In a connection between the output-sided amplifier connection point 2001 and the antenna 2007, the switch 2003 is in a connection state and, at the same time, the switch 2004 is in a disconnection state, thereby connecting between the output-sided amplifier and the antenna. Meanwhile, between the input-sided amplifier connection point 2002 and the antenna 2007, by a disconnection state of the switch 2005 and further a connection state of the switch 2006, a more complete disconnection state is achieved.

On the other hand, during a connection between the input-sided amplifier connection point 2002 and the antenna 2007, the switch is in a connection state and the switch 2006 is in a disconnection state, thereby connecting between the input-sided amplifier and the antenna. Also, between the output-sided amplifier connection point and the antenna, by a disconnection state of the switch 2003 and further a connection state of the switch 2004, a more complete disconnection state is achieved.

According to this embodiment, the switches 2003, 2005 on the both input and output sides have respective signal transmitting fixed electrodes connected to the antenna side. By connecting the movable electrodes of the switches 2004, 2006 and the ground side, it is possible to suppress to the minimum extent the loss and poor disconnection caused due to the parasitic capacitance between the movable electrode and the movable electrode driving fixed electrode.

Figure 22:
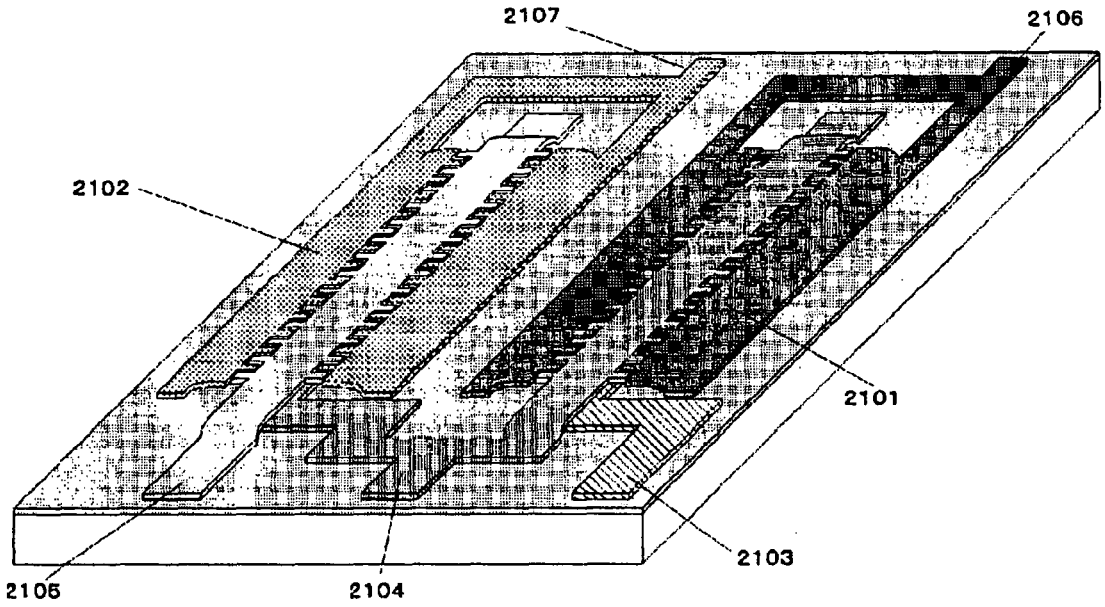
FIG. 22 is a perspective view showing a switch circuit configuration in embodiment 12 of the invention.

FIG. 22 is a perspective view of a switch circuit according to this embodiment. FIG. 22 depicts only one of input and output sides. A series connection switch 2101 has a signal transmitting fixed electrode connected with an antenna and has a movable electrode connected to a fixed electrode of a grounding switch 2102 and to an amplifier. On the other hand, the grounding switch 2102 has a movable electrode connected to the ground side.

In the case of connecting between the amplifier and the antenna, the series connecting switch 2101 makes a connection state between the movable electrode and the signal transmitting fixed electrode while the grounding switch 2102 makes a disconnection state between the movable electrode and the signal transmitting fixed electrode. In this state, only the increase in the parasitic capacitance between the movable electrode and the movable electrode driving fixed electrode of the grounding switch 2102 is involved in signal loss. On the other hand, when disconnecting between the amplifier and the antenna, the series connecting switch 2101 is in a disconnection state between the movable electrode and the signal transmitting fixed electrode while the grounding switch 2102 is in a connection state between the movable electrode and the signal transmitting fixed electrode. There is no increase in the parasitic capacitance contributing to signal loss or poor disconnection. In this manner, by applying this embodiment, the parasitic capacitance increase occurs only in one point, making it possible to suppress loss and poor disconnection to a minimal.

13. Thirteen Exemplary Embodiment

Generally, in configuring a mechanical switch as in the invention, it is often a case to form a beam structure of a conductive material and a substrate of a semiconductor material such as silicon. Consequently, as explained in the related art, in the case that operation environment varies and temperature change occurs, stress is changed by a difference in thermal expansion coefficients between the beam material and the substrate material. The stress change is expressed by Equation 7. S'11 and S'12 respectively represent compliances with respect to a crystal direction. $\Delta\alpha$ represents a difference in thermal expansion coefficient and $\Delta t$ represents a temperature change.

$$\sigma_{11}=[1/\{(S')_{11}+(S')_{12}\}]\cdot\Delta\alpha\cdot\Delta t \quad \text{Equation 7}$$

Now, provided that the beam is of aluminum and the substrate of silicon, these have respective thermal expansion coefficients of $2\times10^{-6}$ [1/K] and $3.0\times10^{-6}$ [1/K]. Accordingly, in the case there is caused a temperature difference of 100° C., stress change amounts to 238 MPa. This embodiment is to compensate for such a temperature change.

Figure 23:
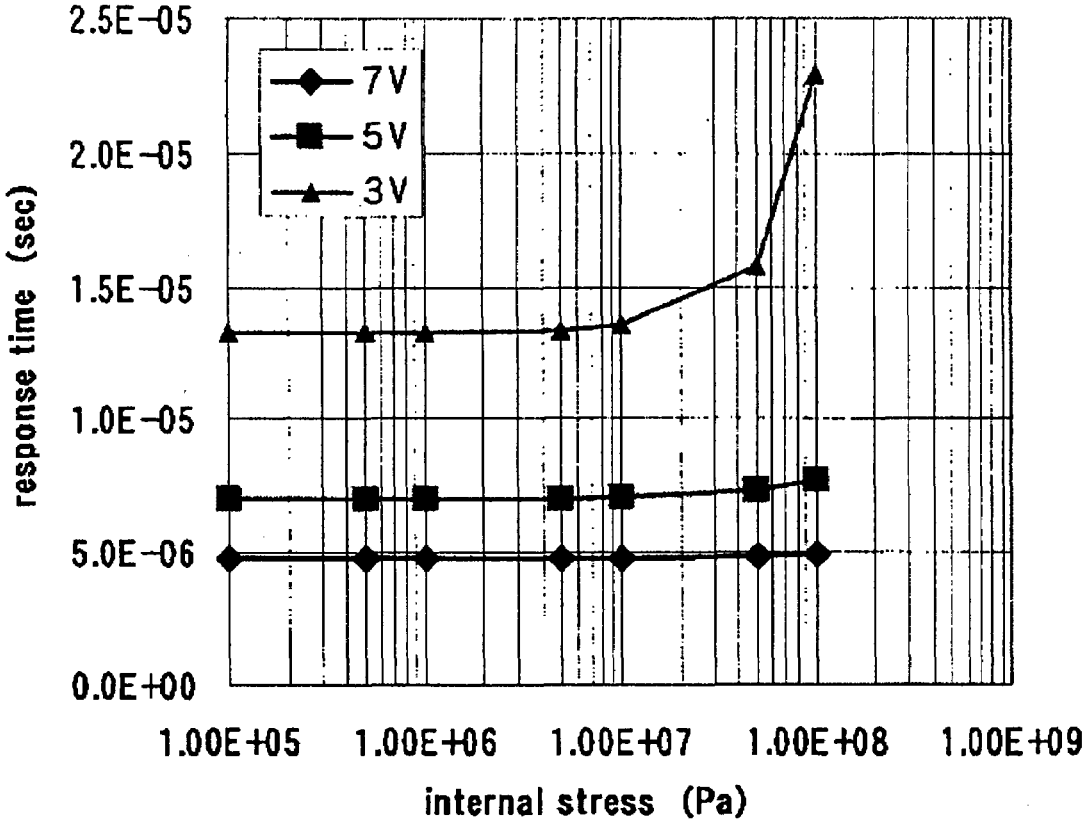
FIG. 23 is a characteristic figure showing a relationship between an internal stress and a response time of a switch of the invention.

FIG. 23 shows a relationship between abeam internal stress and a response time. Herein, shown is a case that the beam has a width of 5 μm, a length of 400 μm and a thickness of 0.7 μm. In the presence of an internal stress change, a beam spring constant is changed. However, electrostatic force is predominant within a range the spring force is sufficiently small relative to the electrostatic force, causing no affection on response time. However, when internal stress changes and residual stress approach to 0, the effect of gravity is not negligible, and the beam is deformed. In this case, in a structure configured by only a signal line electrode and a movable electrode, there is a need to design a gap between the movable electrode and the fixed electrode while taking in to consideration of a maximum deflection amount. Consequently, the beam and the electrode must be sufficiently separated in distance in order to obtain a desired gap even at a temperature at which internal stress is reduced to zero. Accordingly, at a certain temperature, there is a gap greater than that required, naturally increasing the response time.

Accordingly, the present embodiment applies a control voltage between the movable electrode and the movable electrode driving fixed electrode to provide an electrostatic force to, such that the gap is not decreased with a change in temperature. Even if temperature changes, the movable electrode is always pulled up by the movable electrode driving electrode, thus providing a temperature compensating function. FIG. 23 shows a characteristic when the control voltage is changed to 3V, 5V and 7V.

14 Fourteen Exemplary Embodiment

Figure 24:
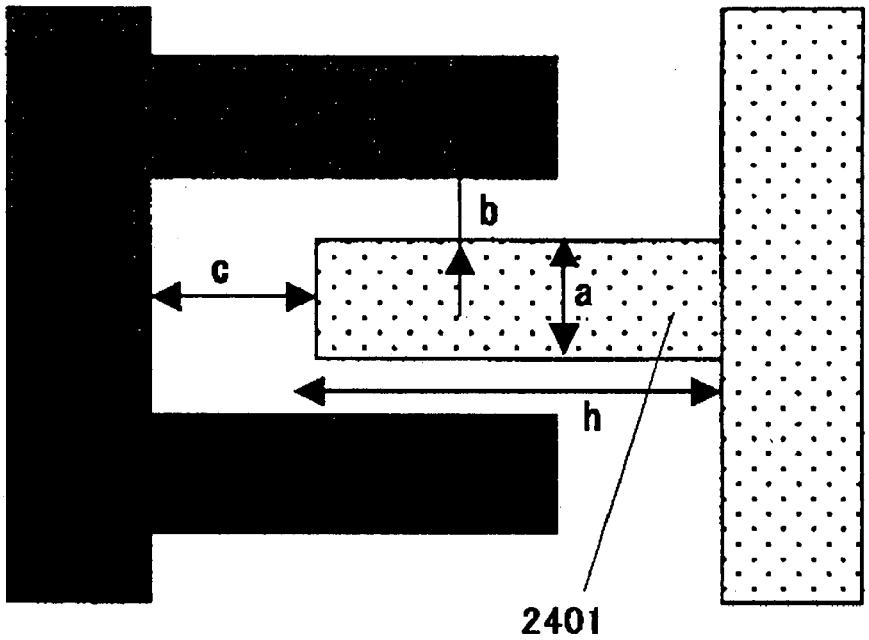
FIG. 24 is a concept view showing an example of a comb part shown in embodiment 13 of the invention.

Embodiments 1 to 13 each have a structure in which a signal is inputted to the signal transmitting fixed electrode. This is because a capacitance region 1705 is caused between the movable electrode and the movable electrode driving electrode when the movable electrode is contacted with the signal transmitting fixed electrode as shown in FIG. 18. Namely, assuming a structure in which a signal should be inputted to the movable electrode and the signal is conveyed to the fixed electrode is employed, the movable electrode is coupled also to the movable electrode driving electrode, even in a state the movable electrode is contacted with the fixed electrode causing a signal loss. However, in order to enhance the freedom of layout, there is a need to provide a structure in which a signal is inputted to the movable electrode side. In such a case, the comb electrode 2401 is narrowed in its width a as shown in FIG. 24. By increasing the impedance of the comb as viewed from the line, a radio frequency signal is prevented from going toward the comb electrode. In order to generate an electrostatic force between the movable electrode and the movable electrode driving electrode, a direct current potential is applied and accordingly a potential is applied to the comb fingers. However, because the comb region has an increased impedance, the radio frequency signal does not structurally enter the comb fingers. Accordingly, there is no possibility that the movable electrode and the movable electrode driving electrode cause a coupling of a radio frequency signal through the comb finger region.

Figure 25:
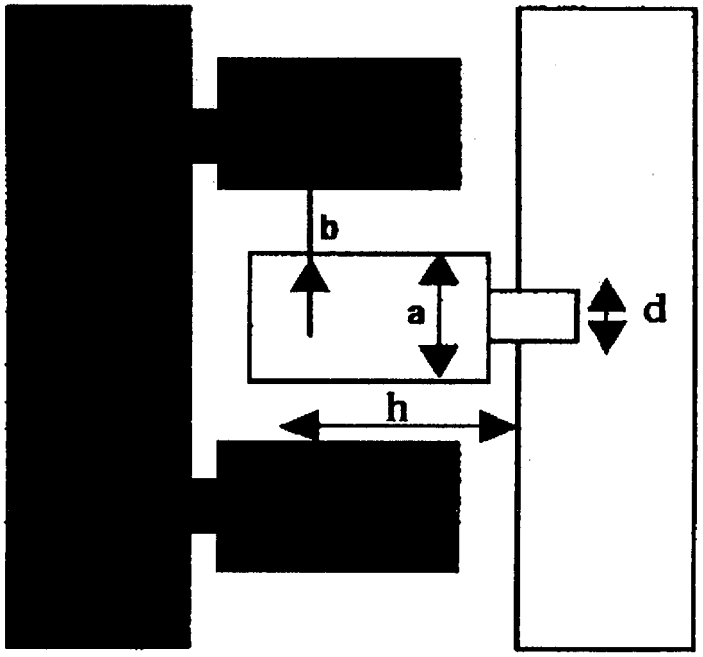
FIG. 25 is a view showing an example of the comb part shown in embodiment 14 of the invention.

For example, provided that the comb electrode 24 has a width a of 10 μm, a length b of 20 μm and a finger-to-finger gap c of 0.6 μm, in the case of FIG. 25 that the finger root is provided with a line structure having a width of 0.5 μm to give a stepwise impedance, though the comb fingers are same in shape, there is coupling of a radio frequency signal between the fingers, causing a loss change. If the number of fingers should be 200, there occurs a difference of approximately 0.1 dB. Naturally, this effect is more useful as the fingers are increased in the number.

Incidentally, impedance may be enhanced by decreasing the finger width instead of the stepwise structure. Also, the comb fingers only may be formed of a material having a high resistance component, to prevent the coupling of a radio frequency signal.

What is claimed is:

1. A switch comprising:

a movable electrode;

a first fixed electrode positioned on both sides of the movable electrode with a predetermined gap; and a second fixed electrode positioned beneath the movable electrode with a predetermined gap to the movable electrode;

wherein a plurality of convex and concave parts are provided at predetermined positions in a side surface of the movable electrode;

a plurality of concave and convex parts are provided in the first fixed electrode respectively corresponding to the convex and concave parts in the side surface of the movable electrode;

the convex parts formed in the side surface of the movable electrode being arranged in a manner surrounded by the concave parts formed in the first fixed electrode; and the convex parts of the first fixed electrode being arranged in a manner surrounded by the concave parts in the side surface of the movable electrode.

2. A switch according to claim 1, wherein the convex parts formed in the side surface of the movable electrode are arranged in a manner surrounded by the concave part formed in the first fixed electrode with a predetermined gap having a distance shorter than a length of the convex part.

3. A switch according to claim 1, wherein the convex part of the first fixed electrode are arranged in a manner surrounded by the concave parts in the side surface of the movable electrode with a predetermined gap having a distance shorter than a length of the convex part of the first fixed electrode.

4. A switch according to claim 1, wherein the movable electrode and the first fixed electrode have a same film thickness.

5. A switch according to claim 4, wherein the movable electrode and the first fixed electrode are formed by etching a film formed in a same process.

6. A switch according to claim 4, wherein the movable electrode and the first fixed electrode are formed by a same plating process.

7. A switch according to claim 1, wherein the movable electrode, the convex and concave parts in the side surface of the movable electrode and the concave and convex parts of the first fixed electrode are formed on a same sacrificial layer.

8. A switch according to claim 7, wherein the movable electrode, the convex and concave parts in the side surface of the movable electrode and the concave and convex parts of the first fixed electrode are formed on a sacrificial layer of resist.

9. A switch according to claim 7, wherein the movable electrode, the convex and concave parts in the side surface of the movable electrode and the concave and convex parts of the first fixed electrode are formed on a sacrificial layer of polyimide.

10. A switch according to claim 1, wherein a step modulating pattern is formed at a predetermined position in a side surface of the second fixed electrode.

11. A switch according to claim 1, wherein a step modulating pattern is formed at a predetermined position in a side surface of the second fixed electrode.

12. A switch according to claim 1, wherein the second fixed electrode has convex and concave part in its side surface corresponding to a plurality of convex and concave parts formed at predetermined positions on a side surface of the movable electrode with respect to a longer-side direction.

13. A switch according to claim 1, wherein the second fixed electrode has a width greater than a distance between the concave parts of the first fixed electrode positioned on both side of the movable electrode.

14. A switch according to claim 1, wherein the second fixed electrode has a width smaller than a distance between the convex parts on both sides of the movable electrode but greater than a distance between the concave parts on both sides of the movable electrode.

15. A switch according to claim 1, wherein the second fixed electrode has a width smaller than a distance between the concave parts on both sides of the movable electrode.

16. A switch according to claim 1, wherein a plurality of holes are provided at predetermined positions on a surface of the movable electrode.

17. A switch according to claim 1, wherein a plurality of holes are provided at predetermined positions on the first fixed electrode.

18. A switch according to claim 1, wherein, in a state the movable electrode is in contact with the second fixed electrode, the plurality of convex and concave parts formed in predetermined positions in a longer-side directional side surface of the movable electrode have a portion vertically overlapped with the concave and convex parts formed in the first fixed electrode.

19. A switch according to claim 1, wherein the plurality of convex parts in a side surface of the movable electrode have an impedance higher than that-of the movable electrode at the portion than the plurality of convex parts.

20. A switch according to claim 1, wherein, in a case the movable electrode moves from a state contacted with the second fixed electrode to a position away from the second fixed electrode with a predetermined gap, a period of applying a voltage between the first fixed electrode and the movable electrode is equal to or less than a time required for the movable electrode to move, from a contacted state with the first fixed electrode, a shortest distance of a predetermined gap formed by the convex part formed on the side surface of the movable electrode and the concave part formed on the first fixed electrode and a predetermined gap formed by the convex part of the first fixed electrode and the concave part on the side surface of the movable electrode.

21. A switch according to claim 1, wherein, in a case the movable electrode moves from a state contacted with the second fixed electrode to a position away from the second fixed electrode with a predetermined gap, a period of applying a voltage between the first fixed electrode and the movable electrode is a time required for the movable electrode to change from a contacted state with the second fixed electrode into a predetermined gap width and contact with the second fixed electrode.

22. A switch according to claim 1, further comprising an amplifier for amplifying a signal, an antenna, a second fixed electrode as a series-connection switch for connecting between the amplifier and the antenna, and a movable electrode as a grounding-connection switch for connection to a ground side, the series-connection switch and the grounding-connection switch being alternately connected and disconnected to thereby carrying out input/output control of a signal.

23. A switch according to claim 1, wherein, in a state the movable electrode is not contacted with the second fixed electrode, an electrostatic force is applied to between the movable electrode and the first fixed electrode when temperature is changed.

* * * * *